US008405009B2

(12) United States Patent
Lim et al.

(10) Patent No.: US 8,405,009 B2
(45) Date of Patent: Mar. 26, 2013

(54) DEFROST HEATER USING STRIP TYPE SURFACE HEAT EMISSION ELEMENT AND FABRICATING METHOD THEREOF AND DEFROST APPARATUS USING THE SAME

(75) Inventors: Hyun Chul Lim, Gwangmyeong-si (KR); Jae Suk Yang, Gimpo-si (KR); Soung Ho Jang, Gimpo-si (KR); Joong Ki Min, Gwangmyeong-si (KR); Sang Dong Jeong, Gimpo-si (KR); Jae Yeong Lee, Seoul (KR); Yong Wook Shin, Gimpo-si (KR)

(73) Assignee: Amogreentech Co., Ltd. (KR)

( * ) Notice: Subject to any disclaimer, the term of this patent is extended or adjusted under 35 U.S.C. 154(b) by 258 days.

(21) Appl. No.: 12/989,929

(22) PCT Filed: Apr. 28, 2009

(86) PCT No.: PCT/KR2009/002216

§ 371 (c)(1),
(2), (4) Date: Dec. 2, 2010

(87) PCT Pub. No.: WO2009/134052

PCT Pub. Date: Nov. 5, 2009

(65) Prior Publication Data

US 2011/0073586 A1 Mar. 31, 2011

(30) Foreign Application Priority Data

| | | |
|---|---|---|
| Apr. 28, 2008 | (KR) | 10-2008-0039562 |
| Jun. 27, 2008 | (KR) | 10-2008-0061743 |
| Sep. 19, 2008 | (KR) | 10-2008-0092032 |
| Oct. 1, 2008 | (KR) | 10-2008-0096379 |
| Apr. 27, 2009 | (KR) | 10-2009-0036691 |

(51) Int. Cl.
*H05B 3/02* (2006.01)
*F25B 13/00* (2006.01)

(52) U.S. Cl. ..... 219/546; 165/62

(58) Field of Classification Search ..... 219/520, 219/521, 543–548; 62/151–156, 159; 165/62, 165/64

See application file for complete search history.

(56) References Cited

U.S. PATENT DOCUMENTS

| | | | | |
|---|---|---|---|---|
| 3,718,535 | A * | 2/1973 | Armstrong et al. | 428/339 |
| 4,432,211 | A * | 2/1984 | Oishi et al. | 62/155 |
| 5,938,957 | A * | 8/1999 | Tanahashi et al. | 219/219 |
| 6,225,608 | B1 * | 5/2001 | Kallgren | 219/465.1 |
| 7,030,344 | B2 * | 4/2006 | Cho et al. | 219/520 |
| 2004/0200597 | A1 | 10/2004 | Cho et al. | |
| 2007/0000271 | A1 | 1/2007 | Lee et al. | |

FOREIGN PATENT DOCUMENTS

| | | |
|---|---|---|
| JP | 55-28222 | 2/1980 |
| JP | 2004-317031 | 11/2004 |

(Continued)

OTHER PUBLICATIONS

International Search Report—PCT/KR2009/002216 dated Oct. 20, 2009.

*Primary Examiner* — Sang Paik
(74) *Attorney, Agent, or Firm* — Cantor Colburn LLP

(57) ABSTRACT

Provided is a defrost heater using a surface heat emission element of a metal thin film having a fast temperature response performance and a low thermal density, to thereby use an environment-friendly refrigerant, and that performs quick temperature rising and cooling during performing a defrost cycle, to thereby quickly restart a refrigeration cycle and thus greatly reduce time required for the defrost cycle, and a fabricating method thereof, and a defrost apparatus using the same. The defrost heater includes: a strip type surface heat emission element made of a strip type metal thin plate; an insulation layer that coats the outer circumference of the strip type surface heat emission element; and a heat transfer board on one side surface of which the surface heat emission element on the outer circumferential surface of which the insulation layer has been coated is installed, and that contacts evaporator fins so that heat generated from the surface heat emission element is transferred to an evaporator.

10 Claims, 24 Drawing Sheets

FOREIGN PATENT DOCUMENTS

| | | |
|---|---|---|
| KR | 1998-010548 | 5/1998 |
| KR | 10-2004-0087580 | 10/2004 |
| KR | 10-2005-0003704 | 1/2005 |
| KR | 10-2006-0014483 | 2/2006 |
| WO | 00/66959 | 11/2000 |

* cited by examiner

DEFROST HEATER USING STRIP TYPE SURFACE HEAT EMISSION ELEMENT AND FABRICATING METHOD THEREOF AND DEFROST APPARATUS USING THE SAME

TECHNICAL FIELD

The present invention relates to a defrost heater using a strip type surface heat emission element and a fabricating method thereof, and a defrost apparatus using the same. More particularly, the present invention relates to a defrost heater using a strip type surface heat emission element and a fabricating method thereof, and a defrost apparatus using the same, in which the strip type surface heat emission element is made of a metal thin film in order to remove frost that is produced in an evaporator of a refrigerator and so on.

BACKGROUND ART

In general, a refrigerator includes: a main body that is divided into a freezing room and a cold-storage room; a door unit that rotationally opens and closes the front opening portions of the freezing room and the cold-storage room; and a refrigerating apparatus that cools the inside of the freezing room and the cold-storage room.

The refrigerating apparatus includes: a compressor that compresses a gas phase refrigerant into a high temperature and high pressure refrigerant; a condenser that condenses the gas phase refrigerant that has been compressed at the compressor into a liquid phase refrigerant; a capillary tube that changes the liquefied refrigerant into a low temperature and low pressure refrigerant; and an evaporator that vaporizes the refrigerant that has been liquefied into the low temperature and low pressure refrigerant at the capillary tube to thereby absorb evaporation latent heat and thus cool surrounding air. The refrigerating apparatus supplies the cooled air around the evaporation to the inside of the freezing room and the cold-storage room, using a blower, to thereby cool the inside of the freezing room and the cold-storage room.

Since a surface temperature of the evaporator that is provided in the refrigerating apparatus of this refrigerator is lower than the temperature in the refrigerator, water that exists in the internal air of the refrigerator is attached to the surface of the evaporator in the form of frost. Since the frost causes to decrease a heat exchange ability of the evaporator, a defrost heater is installed in order to remove frost that is attached to the evaporator.

Referring to FIGS. 1 and 2, a defrost heater that is installed in a refrigerator will be described as an example among various types of heaters.

As shown in FIG. 1, an evaporator 1 of a refrigerator is made of a tube 2 that is bent in a zigzag form and through which a refrigerant flows, and a number of fins 3 that enclose the tube 2 to perform a heat exchange function with respect to the tube 2. The number of the fins 3 are formed into a structure that a plurality of fins are formed by respective horizontal lines of the tube 2 or a structure that a plurality of vertical fins are formed into a single fin unit to enclose the whole horizontal lines. The tube 2 through which the refrigerant flows passes through the central portion of the number of the fins 3, to thereby improve a heat exchange performance.

Since frost is attached to the surface of the evaporator 1 of this refrigerator is covered with during performing a refrigerating cycle, a defrost heater that removes frost is provided.

A conventional defrost apparatus includes: first and second defrost heaters 4 and 5 that are bent in a zigzag form on the front and rear surfaces of the evaporator 1 and are mounted to be in a line contact with the fins 3; and a third defrost heater 6 that is mounted at the lower side of the evaporator 1. The conventional defrost apparatus executes a defrost cycle that removes frost formed on the surface of the evaporator 1 periodically.

In the case of the conventional defrost apparatus, the first and second defrost heaters 4 and 5 are installed to be in a line contact with the evaporator 1 and the third defrost heater 6 is installed at a distance from the evaporator 1 at the lower side of the evaporator 1.

In this case, the first to third defrost heaters 4, 5, and 6 can be formed of a sheath heater or glass heater, respectively. Heat that is produced in the sheath heater and glass heater melts frost that has been attached to the evaporator 1 in a radiation or convection method to thereby remove the frost.

In this way, since the first defrost heater 4 and the second defrost heater 5 are mounted on the front and rear surfaces of the evaporator 1 in the case of the conventional defrost apparatus, and the third defrost heater 6 is installed at the lower side of the evaporator 1, a heat emission temperature should be increased due to a temperature difference depending upon the positions, respectively.

However, since the first to third defrost heaters 4, 5, and 6 are in line contact with the evaporator 1 and installed at a distance from the evaporator 1 in the conventional technology, a problem of lowering a defrost efficiency has been caused. In addition, since the first to third defrost heaters 4, 5, and 6 respectively having a large heater capacity are required in order to improve a defrost performance, a problem of increasing electric power consumption has been caused.

In general, a sheath heater is fabricated by coiling a heat wire in a tube and charging high purity magnesium oxide whose heat insulation and heat conductivity are excellent in a high pressure state. Since the sheath heater is strong with respect to an external mechanical impact or shock, has a long life-time, and has no declination of an insulation capability even in the case of using it under the high temperature circumstances, it is known that the sheath heater is very safe electrically.

However, the sheath heater applied to a defrost heater restricts its heat emission area due to spatial restriction and has a high electric power (Watt) density in the heater. Accordingly, the sheath heater has a very high surface temperature characteristic but has a very low temperature response performance. As a result, there is a problem that the sheath heater is not converted into a refrigerating cycle quickly after completion of the defrost operation.

That is, since the defrost heater that uses a tubular type heater such as the sheath heater performs high temperature heat emission commonly, it may cause a problem in safety. In addition, since electric power of the defrost heater is turned off and a compressor is operated simultaneously when the defrost operation has been completed, the defrost heater has long cooling time that is taken to lower temperature of a refrigerant tube until a point in time when a refrigerating cycle of the refrigerating apparatus is reactivated, that is, down to 0 (that is, a heater temperature response performance is slow), there is a problem that the whole defrost cycle is prolonged. That is, if the defrost cycle is prolonged, it cannot be converted from the defrost cycle into the refrigerating cycle after completion of defrost. Accordingly, there is a problem that a freezing performance falls.

In addition, since a conventional tube shaped defrost heater is thick, it is limited to install and use the defrost heater in various defrost apparatuses. Further, there has been a problem that an assembly performance and a productivity fall.

Meanwhile, in order to improve the problems of the defrost heater that uses the sheath heater, the Korean Patent No. 584274 has proposed a defrost apparatus including: an evaporator having a fin-tube; and a defrost heater unit having first and second defrost heaters that have an insulation film and a heater wire that is coated on the insulation film, and whose surface is formed of a corrugated surface, to thus be attached on the front and rear surfaces of the evaporator, and to thereby remove a layer of frost produced on the surface of the evaporator, in which the defrost heaters are depressed and fixed by the corrugated surface of the defrost heaters between both side surfaces of the evaporator and an inner fixed portion of the cold-storage room facing the evaporator.

In the case of the defrost heater, the heater wire of a zigzag form is coated by the insulation film that has an unevenness corrugated surface so that the tube is applied in the structure of the evaporator arranged at the outside of the fins, and the defrost heater is mounted in a tube bracket and a tube that are vertically installed on both sides of the defrost heater, using an adhesive.

However, since the tube bracket has a structure of the whole evaporator with a trapezoidal structure so that a number of tubes that are vertically and horizontally arranged at crossing points of straight lines and curved lines are piercingly inserted at the left/right sides of an "S" shape of the tubes, both side ends of the defrost heater of the corrugated surface shape preferentially contact the tube brackets of both sides of the defrost heater. Accordingly, the defrost heater has a structure that is difficult to be in substantially direct contact with the tubes.

In addition, the heater wire of the defrost heater is made of a wire having a high thermal density and expensive nichrom. Accordingly, the outer circumference of the wire should be primarily insulated and coated to thereby cause a low heat transfer efficiency. In addition, a thick insulation film should be used to thereby also cause a low heat transfer efficiency.

Meanwhile, the Korean Utility-model Publication No. 1998-10548 discloses a defrost apparatus in which a carbon paste is formed in a plate shaped member in a pattern form of a parallel connection structure as a heat emission element, and a linear electric conductor is connected between both ends of the defrost apparatus.

However, the defrost apparatus that uses a carbon heater as the heat emission element, has the difficulty in realizing a heater of high capacity of 200 W, and performs heat emission of 40 or so generally. As a result, if the carbon heater is used for the defrost apparatus, there is a problem that a low temperature response performance is slow similarly to that of the sheath heater.

In addition, when the carbon heater is coated by a plastic film for insulation, there is a problem that the carbon heater becomes weak for thermal shock. Further, the carbon that acts as a heat emission element has a shortcoming that physical properties are changed in use long hours.

Meanwhile, when the sheath heater is used as the defrost heater, heat emission is attained up to about 600° C. In this connection, since R11 or R22 that is a current non-environment-friendly refrigerant has a high ignition point, the sheath heater can be used without causing a big problem. However, the non-environment-friendly refrigerant cannot be adopted for products that are manufactured from Jan. 1, 2010. Further, even in the case of the existing products that employ the non-environment-friendly refrigerant, use of R22 is prohibited according to the Uruguay Round agreement from 2020 onward, and only environment-friendly refrigerants such as R600a (isobutane: $CH(CH_3)_3$); and Refrigerant boiling point: 460° C.) will be allowed for use by SA53 that is defrost heater requirements of the Chapter 5 of the UL (Underwriters Laboratories Inc) 250.

According to the UL 250 standards, when a refrigerant has been leaked, the surface temperature of a defrost heater is restricted to be lower by 100 than an ignition point of the refrigerant, in order to prevent firing of the refrigerant. Therefore, when using new refrigerants such as R600a, R600 (n-butane: $CH_3CH_2CH_2CH_3$: Refrigerant boiling point: 365° C.) and R290 (propane; $CH_3CH_2CH_3$; Refrigerant boiling point: 470° C.) unlike the existing refrigerants, it is required that the surface temperature of the heater should be controlled not more than almost 270° C. because of the ignition point of the refrigerant.

However, when the existing sheath heater or glass heater having the high power density is used as the heater, it is difficult to satisfy the surface temperature of the heater as a limited temperature that is newly specified by the UL 250 standards for the ignition point of the refrigerant, that is, a condition that is lower by 100 than the ignition point of the refrigerant. In this case, if temperature is risen, fire may occur by the leaked refrigerant.

DISCLOSURE

Technical Problem

As described above, the sheath heater that is mainly used for the defrost apparatus has a low electric power to heat conversion efficiency due to a slow temperature response performance, and has the difficulty in quickly converting the defrost cycle into a refrigerating cycle after defrost. In addition, an expensive controller should be used in the sheath heater so as to perform heat emission at a low-temperature state sufficiently lower than the ignition point of the environment-friendly refrigerant. Further, in the case that the controller is out of order, a problem that the whole evaporator changes into a lump of ice happens.

In addition, since the conventional defrost apparatus employs the heater having a heater capacity of 200 W at minimum, electric power consumption is big, defrost time is long, and the defrost cycle is not quickly converted into a refrigerating cycle after completion of defrost, to thereby cause a problem that heightens temperature of the cold-storage room.

Therefore, development of a new heater is required to replace a heat emission element of the heater that is used for the conventional defrost apparatus. The new heater has a fast temperature response performance, performs to defrost while heat emission is achieved at a low-temperature state sufficiently lower than the ignition point of the environment-friendly refrigerant, is strong for thermal shock, and causes natural disconnection, that is, automatic electric cutoff in the case that temperature of the heater is risen not less than the ignition point of the environment-friendly refrigerant, to thus secure safety.

In the case that a metal thin plate is slitted in a linear shape or when a surface heat emission element that is patterned in a zigzag pattern is used as a heat emission element of a heater, this inventor has considered that heat emission is basically attained at a temperature not more than an ignition point of a refrigerant because of low thermal density, and thus temperature control of the heater is possible by a simple ON/OFF control without using any expensive controller and has a very fast temperature response performance, and is strong even for thermal shock, and has completed the present invention.

To solve the above problems, it is an object of the present invention to provide a defrost heater that employs a metal thin film surface heat emission element having a fast temperature response performance and a low thermal density, to thereby provide excellent safety since temperature of the heater is sufficiently lower than an ignition point of the environment-friendly refrigerant, and achieve rapid temperature rising in operation of a defrost cycle, and that performs quick cooling after completion of defrost, to thereby quickly restart a refrigeration cycle and thus greatly reduce time required for the defrost cycle.

It is another object of the present invention to provide a defrost heater that employs a metal thin film surface heat emission element having a low thermal density, to thereby attain low temperature heat emission, to thus make thickness of an insulation layer thinned to realize a slim heater, and to heighten a heat transfer efficiency to maintain maximization of an electric power to heat conversion efficiency.

It is still another object of the present invention to provide a defrost heater that employs a strip type metal thin film surface heat emission element that are in direct contact equally with the whole parts of a number of evaporator fins, in order to transfer heat, to thereby improve a defrost efficiency and decrease electric power consumption.

It is yet another object of the present invention to provide a defrost heater that can be freely manufactured according to size and form of an evaporator, and that has a simple structure and an easy manufacturing process, to thus attain cost-saving.

It is still yet another object of the present invention to provide a defrost heater using a surface heater, in which a sheath heater for defrost is replaced by the surface heater that is installed so as to contact the front and rear surfaces of an evaporator, to thereby transfer heat by a conduction method in order to perform defrost, and to thus heighten a defrost efficiency by performing an effective defrost with a low capacity heater.

It is a further object of the present invention to provide a defrost heater using a surface heater, in which the surface heater is arranged in the lower end of an evaporator, to thereby prevent a phenomenon of melting ice that has been already produced in an ice maker of the top portion of the evaporator and causing the melted ice to be stuck each other.

It is a still further object of the present invention to provide a defrost heater using a strip type surface heat emission element and a method of assembling the same, in which a number of linear surface heat emission elements are connected in series to and/or in parallel with each other to have a proper capacity as a heater for use in a defrost apparatus, using a pair of heater assembly PCBs (printed circuit boards), to thereby heighten assembly productivity, durability and reliability, and assemble a heater assembly into a slim type.

It is a yet further object of the present invention to provide a defrost apparatus that can perform a temperature control by a simple ON/OFF control without using any expensive controller.

It is a yet still further object of the present invention to provide a defrost heater in which an amorphous material is used as a material of a surface heat emission element, and is crystallized in the case that temperature of the heater is risen above an ignition point of an environment-friendly refrigerant, to thereby cause natural electric cutoff and to thus secure safety due to overheat.

Technical Solution

To accomplish the above objects of the present invention, according to a first aspect of the present invention, there is provided a defrost heater that removes frost that is produced on an evaporator of a refrigerating apparatus, the defrost heater comprising:

a strip type surface heat emission element made of a strip type metal thin plate;

an insulation layer that coats the outer circumference of the strip type surface heat emission element; and a heat transfer board on one side surface of which the surface heat emission element on the outer circumferential surface of which the insulation layer has been coated is installed, and that contacts evaporator fins so that heat generated from the surface heat emission element is transferred to an evaporator.

According to a second aspect of the present invention, there is provided a defrost heater comprising:

a number of surface heat emission elements made of a strip style metal thin plate, respectively;

at least a pair of series connection units that connect in series both side ends of the number of the adjoining surface heat emission elements, respectively;

a heat transfer board on one side surface of which the number of the surface heat emission elements are installed, and on the other side surface of which an evaporator is attached; and an insulation layer that coats the number of the surface heat emission elements that have been installed on one side surface of the heat transfer board.

According to a third aspect of the present invention, there is provided a defrost heater comprising: a defrost heater that removes frost that is produced on an evaporator of a refrigerating apparatus, the defrost heater comprising:

a heater assembly that is formed of a strip type surface heat emission element of a metal thin plate that is formed in a zigzag style pattern and has a fast temperature response performance and a low thermal density, and on the outer circumferential surface of which an insulation film is laminated in a plate form; and a heat transfer board on one side surface of which the heater assembly is installed, and on the other side surface of which an evaporator is attached.

According to a fourth aspect of the present invention, there is provided a defrost heater comprising: a defrost heater comprising:

a strip type surface heat emission element made of a strip type metal thin plate;

a heat transfer board that receives heat generated from the surface heat emission element and transfers the received heat to the evaporator;

a first insulation layer that fixes the strip type surface heat emission element on the heat transfer board and simultaneously insulates the strip type surface heat emission element; and a second insulation layer that intercepts heat from being transferred to the upper portion of the strip type surface heat emission element.

According to a fifth aspect of the present invention, there is provided a defrost heater comprising: a defrost heater that removes frost that is produced on an evaporator of a refrigerating apparatus through which a refrigerant flows, the defrost heater comprising:

a heater assembly that comprises: first and second heater assembly PCBs that comprise a number of first and second conductive connection pads that are arranged at predetermined intervals, respectively, and a number of strip type surface heat emission elements that are made of a strip type metal thin film and both ends of which are connected between the number of the first conductive connection pads of the first heater assembly and the number of the second conductive connection pads of the second heater assembly;

a heat transfer board that is closely fixed to one side surface of the evaporator and receives heat generated from the number of the strip type surface heat emission elements that have been mounted on the outer surface of the evaporator and transfers the received heat to the evaporator; and an insulation layer that seals an exposed portion of the heater assembly.

According to a sixth aspect of the present invention, there is provided a defrost heater comprising: a defrost apparatus that removes frost that is produced on an evaporator of a refrigerating apparatus through which a refrigerant flows, the defrost apparatus comprising:

first and second defrost heaters that are in contact on front and rear surfaces of an evaporator, wherein each of the first and second defrost heaters comprises:

a heater assembly that comprises: first and second heater assembly PCBs that comprise a number of first and second conductive connection pads that are arranged at predetermined intervals, respectively, and a number of strip type surface heat emission elements that are made of a strip type metal thin film and both ends of which are connected between the number of the first conductive connection pads of the first heater assembly and the number of the second conductive connection pads of the second heater assembly;

a heat transfer board that is closely fixed to one side surface of the evaporator and receives heat generated from the number of the strip type surface heat emission elements that have been mounted on the outer surface of the evaporator and transfers the received heat to the evaporator; and an insulation layer that seals an exposed portion of the heater assembly.

According to a seventh aspect of the present invention, there is provided a defrost heater comprising: a defrost apparatus that removes frost that is produced on an evaporator of a refrigerating apparatus in which a number of fins are formed to enclose the whole horizontal line of a tube through which a refrigerant flows and that is bent in a zigzag form, the defrost apparatus comprising:

front and rear defrost heaters that are opposingly arranged on front and rear surfaces of the lower portion of an evaporator, so as to contact the fins, wherein each of the front and rear defrost heaters comprises:

a strip type surface heat emission element made of a number of strips that are obtained by slitting a metal thin plate, in which heat emission is performed when electric power is applied to both ends of the strips, the number of the strips are arranged in parallel with each other at intervals, and both side ends of the respective adjoining strips are connected with each other;

a heat transfer board that receives heat generated from the strip type surface heat emission element and transfers the received heat to the evaporator;

a first insulation layer that fixes the strip type surface heat emission element on the heat transfer board and simultaneously insulates the strip type surface heat emission element; and a second insulation layer that intercepts heat from being transferred to the upper portion of the strip type surface heat emission element.

According to an eighth aspect of the present invention, there is provided a defrost heater comprising: a defrost apparatus comprising: front and rear defrost heaters that are opposingly arranged on front and rear surfaces of the lower portion of the evaporator, and remove frost that is produced on an evaporator, wherein each of the defrost heaters comprises:

a surface heat emission element made of a metal thin plate in a zigzag pattern form;

an insulation layer that coats outer circumference of the surface heat emission element; and a heat transfer board that fixes the insulation layer that coats the surface heat emission element and transmits heat of the surface heat emission element toward the evaporator.

According to a ninth aspect of the present invention, there is provided a defrost heater comprising: a method of manufacturing a defrost heater, the defrost heater manufacturing method comprising the steps of:

preparing a number of strip type surface heat emission elements by slitting a metal thin film material and then cutting the slitted metal thin film material;

preparing a first heater assembly PCB in which a number of first conductive connection pads are formed at given intervals and a second heater assembly PCB in which a number of second conductive connection pads are formed at given intervals;

forming a heater assembly by connecting in series both ends of the number of the strip type surface heat emission elements between the number of the first conductive connection pads of the first heater assembly and the number of the second conductive connection pads of the second heater assembly;

attaching the heater assembly on one surface of the heat transfer board and sealing an exposed portion of the heater assembly; and connecting a pair of electric power cables from a pair of connection pads that are arranged at both ends of the number of the first conductive connection pads to a pair of electric power supply terminal pads that are formed on the rear surface of the first heater assembly PCB through a throughhole, respectively.

According to a tenth aspect of the present invention, there is provided a defrost heater comprising: a method of manufacturing a defrost heater, the defrost heater manufacturing method comprising the steps of:

preparing a surface heat emission element by molding a ribbon shaped broad width surface heat emission element material in which a number of strips are arranged in parallel at intervals and both side ends of the respective adjoining strips are selectively connected mutually;

coating the outer portion of the surface heat emission element as an insulation layer and forming a heater assembly; and fixing the heater assembly on a heat transfer board.

According to an eleventh aspect of the present invention, there is provided a defrost heater comprising: a method of manufacturing a defrost heater, the defrost heater manufacturing method comprising the steps of:

molding a metal thin plate and preparing a strip type surface heat emission element;

attaching the surface heat emission element on a heat transfer board that transfers heat of the surface heat emission element; and coating an insulation layer on the upper portion of the attached surface heat emission element.

Advantageous Effects

Therefore, the present invention employs a metal thin film surface heat emission element having a fast temperature response performance and a low thermal density, to thereby provide excellent safety since temperature of the heater is sufficiently lower than an ignition point of the environment-friendly refrigerant, and achieve rapid temperature rising in operation of a defrost cycle, and performs quick cooling after completion of defrost, to thereby quickly restart a refrigeration cycle and thus greatly reduce time required for the defrost cycle.

In addition, the present invention employs a metal thin film surface heat emission element having a low thermal density, to thereby attain low temperature heat emission, to thus make thickness of an insulation layer thinned to realize a slim heater, and to heighten a heat transfer efficiency to maintain maximization of an electric power to heat conversion efficiency.

Further, the present invention equally transfers heat generated from a strip type metal thin film surface heat emission element directly to an evaporator via fins without causing any loss, to thereby maximize a defrost efficiency and decrease electric power consumption.

Moreover, the present invention can be freely and easily manufactured without having any limitation according to size and form of an evaporator, and has a simple structure and an easy manufacturing process, to thus attain cost-saving.

In addition, the present invention uses a surface heat emission element that is obtained by fabricating a metal thin film in a linear form, and uses a pair of heater assembly PCBs (printed circuit boards), when a number of linear surface heat emission elements are connected in series to and/or in parallel with each other to have a proper capacity as a heater for use in a defrost apparatus, to thereby heighten assembly productivity, durability and reliability, and assemble the heater assembly into a slim type.

In addition, the present invention employs a metal thin film surface heat emission element having a low thermal density, to thereby basically achieve heat emission at a temperature not more than an ignition point of a refrigerant, and to thus enable temperature control of the heater to be performed by a simple ON/OFF control without using any expensive controller and has a very fast temperature response performance, and is strong even for thermal shock, and heightens a heat transfer efficiency to aim to maximize an electric power to heat conversion efficiency.

Further, the present invention uses an amorphous material as a material of a surface heat emission element, and is crystallized in the case that temperature of the heater is risen above an ignition point of an environment-friendly refrigerant, to thereby cause natural electric cutoff and to thus secure safety due to overheat.

BEST MODEL

In order to sufficiently understand this invention, operational advantages of this invention, and purposes that are attained by implementation of this invention, accompanying drawings illustrating preferred embodiments of this invention and contents that are described with reference to the accompanying drawings must be referred to.

The above and/or other objects and/or advantages of the present invention will become more apparent by the following description.

Hereinbelow, a defrost heater using a strip type surface heat emission element and a fabricating method thereof, and a defrost apparatus using the same, according to respective embodiments of the present invention will be described with reference to the accompanying drawings in detail.

Figure 1:
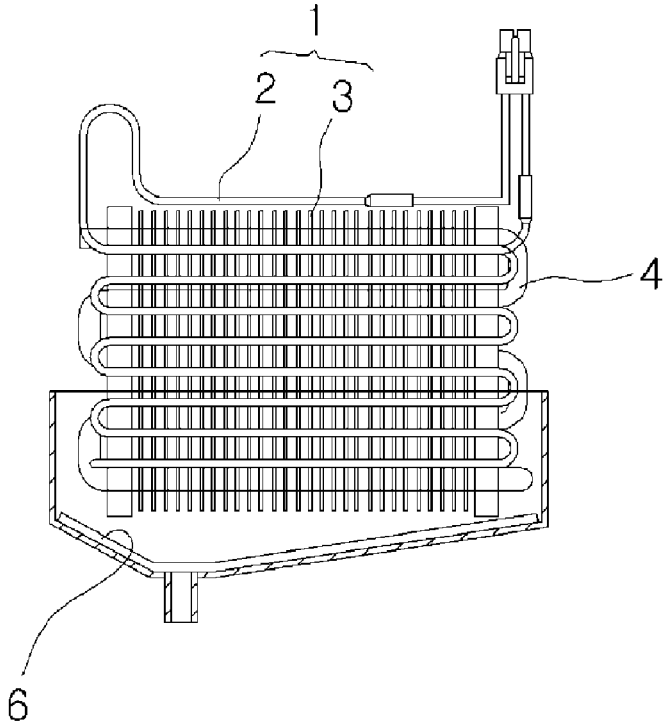
FIG. 1 is a front view showing an evaporator having a defrost heater according to conventional art.
Figure 2:
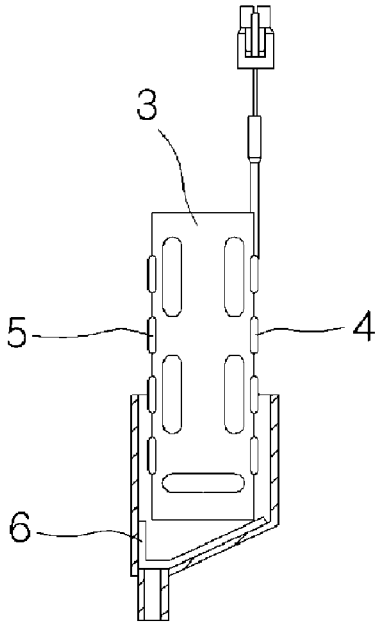
FIG. 2 is a side view of the defrost heater illustrated in FIG. 1.
Figure 3:
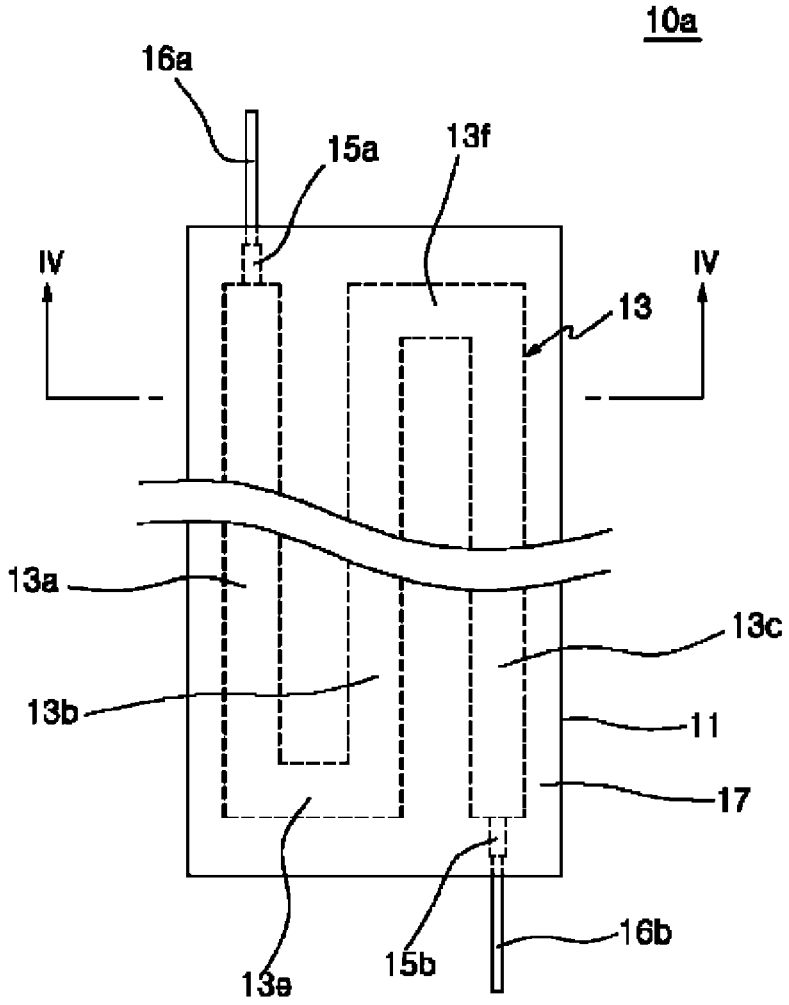
FIG. 3 is a plan view showing a defrost heater using a strip type surface heat emission element according to a first embodiment of this invention.
Figure 4:
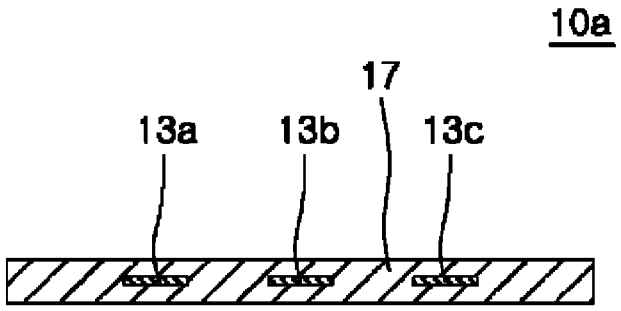
FIG. 4 is a cross-sectional view of the defrost heater cut along a line IV-IV of FIG. 3.
Figure 5:
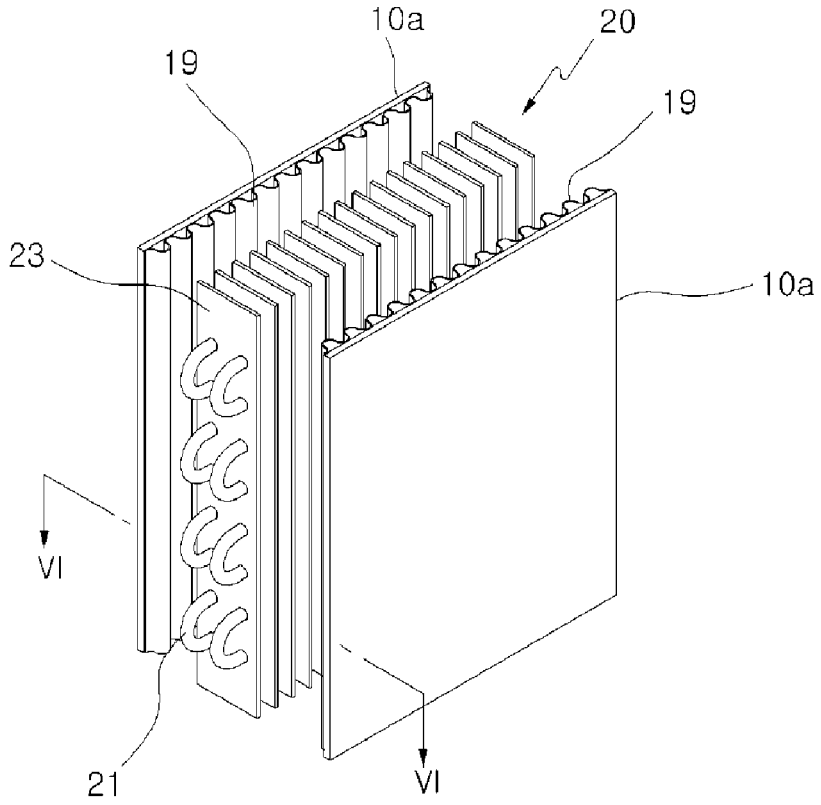
FIG. 5 is a perspective view showing a state where that a pair of defrost heaters are arranged at both sides of an evaporator according to the first embodiment of the present invention.
Figure 6:
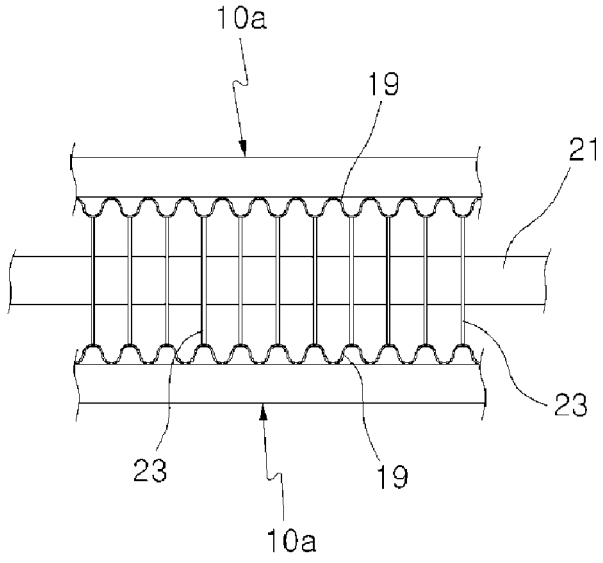
FIG. 6 is a cross-sectional view of the defrost heater cut along a line VI-VI of FIG. 5, at the state where the pair of the defrost heaters have been arranged at both sides of the evaporator.
Figure 7:
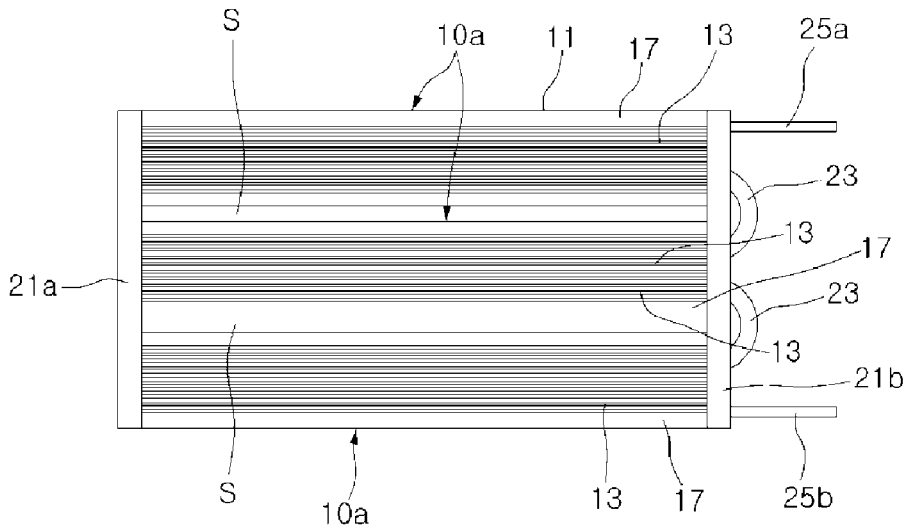
FIG. 7 is a cross-sectional view of a defrost heater unit that is configured into a single heater unit by connecting a number of the defrost heaters according to the first embodiment of the present invention.

FIG. 3 is a plan view showing a defrost heater using a strip type surface heat emission element according to a first embodiment of this invention. FIG. 4 is a cross-sectional view of the defrost heater cut along a line IV-IV of FIG. 3. FIG. 5 is a perspective view showing a state where that a pair of defrost heaters are arranged at both sides of an evaporator according to the first embodiment of the present invention. FIG. 6 is a cross-sectional view of the defrost heater cut along a line VI-VI of FIG. 5, at the state where the pair of the defrost heaters have been arranged at both sides of the evaporator. FIG. 7 is a cross-sectional view of a defrost heater unit that is configured into a single heater unit by connecting a number of the defrost heaters according to the first embodiment of the present invention.

First, referring to FIGS. 3 and 4, a defrost heater 10*a* using a strip type surface heat emission element according to a first embodiment of this invention includes: a rectangular aluminum heat transfer board 11 of a predetermined size; a strip type surface heat emission element 13 at both ends of which first and second electrode terminals 15*a* and 15*b* are provided; and insulation layers 17 enclosing upper and lower outer surfaces of the strip type surface heat emission element 13.

In addition, the defrost heater 10*a* of this invention can further include a corrugation type radiation fin 19 on the outer surface of the heat transfer board 11 so as to be in elastic contact with a number of evaporator fins 23 as shown in FIG. 5.

The heat transfer board 11 is formed of a plate shape. It is possible to bend both ends of the heat transfer board 11 in an equal direction and to perform a finish coat. The heat transfer board 11 plays a role of radiating (that is, discharging, transferring or delivering) heat that is produced in the strip type surface heat emission element 13 to the outside.

Therefore, the heat transfer board 11 is made of one of Al, Cu, Ag and Au or an alloy material thereof, that has an excellent heat transfer property. Preferably, the heat transfer board 11 is made of inexpensive aluminum or aluminum alloy. In this case, the heat transfer board is anodized to form an insulator film for electrical insulation on the surface thereof.

The strip type surface heat emission element 13 is formed by slitting a metal thin film of predetermined thickness in which case strips 13*a*-13*c* are formed in a pattern that is continuous in a zigzag form. An insulation layer 17 that performs a moisture-proof, heat-resistant and electric insulation functions is coated on the outer surface of the strip type surface heat emission element 13.

In this case, it is desirable to form the insulation films 17 that are coated in a plate shape on the outer circumferences of the strip type surface heat emission element by laminating the strip type surface heat emission element 13 at a state where a number of the strips 13*a*-13*c* that are formed in a pattern between the upper and lower insulation films 17 have been arranged.

Both ends of the number of the strips 13*a*-13*c* are connected in any one connection method among a series connection, a parallel connection and a combination of series and parallel connections to set a resistance value required by the heater.

Such a strip type surface heat emission element 13 can be made of any one among a metal thin plate of a single element such as Fe, Al, and Cu, an iron-series (Fe—X) or iron chrome-series (Fe—Cr) metal thin plate, FeCrAl alloy thin plate such as Fe-(14 to 21%)Cr-(2 to 10%)Al, a nichrom heat wire material made of Ni (77% or more), Cr (19 to 21%) and Si (0.75 to 1.5%), or Ni (57% or more), Cr (15 to 18%), Si (0.75 to 1.5%) and Fe (remaining parts), and an amorphous thin plate (ribbon).

Fecalloy alloy (that is called a KANTHAL™ wire) that is composed at the rate of Fe-15Cr-5Al or Fe-20Cr-5Al-REM (rare earth metal) (here, including REM (Y, Hf, Zr) of 1% or so) can be used as a desirable alloy material of the FeCrAl alloy thin plate.

In addition, the amorphous thin plate is made of a Fe-based or Co-series amorphous material, and the Fe-based amorphous material that is inexpensive relatively is preferably used.

The Fe-based amorphous material is, for example, $Fe_{100-u-y-z-w}R_uT_xQ_yB_zSi_w$. Here, R is at least one of Ni and Co, T is at least one of Ti, Zr, Hf, V, Nb, Ta, Mo and W, Q is at least one of Cu, Ag, Au, Pd and Pt, and u is 0 to 10, x is 1 to 5, y is 0 to 3, and z is 5 to 12, and w is 8 to 18.

The Co-series amorphous material is, for example, $(Co_{1-x1-x2}Fe_{x1}M_{x2})_{x3}B_{x4}$. Here, M is one or more elements selected from the group consisting of Cr, Ni, Mo and Mn, and x1, x2, and x3 are $0 \leqq x1 \leqq 0.10$, $0 \leqq x2 \leqq 0.10$, and $70 \leqq x3 \leqq 79$, respectively, in the amorphous alloy. A composition ratio of B, that is, x4 is $11.0 \leqq x4 \leqq 13.0$.

The most desirable material is a Fe-15Cr-5Al or Fe-based amorphous material among the materials for the strip type surface heat emission element 13. In the case that Fe-15Cr-5Al is thermally treated, an $Al_2O_3$ (alumina) insulation film is formed on the surface thereof, to thereby have a high temperature corrosion-resistant property and provide an advantage of solving an oxidation problem of an iron-series material inexpensively.

In addition, among well-known high temperature heat wire materials, it is known that a specific resistance of NIKROTHAL™ (Ni:80) of a nichrom (NiCr) heat wire is 1.09 $\Omega mm^2/m$, and that of KANTHAL™ D is 1.35 $\Omega mm^2/m$. By the way, it can be seen that since the Fe-based amorphous thin plate (ribbon) has a specific resistance of 1.3 to 1.4 $\Omega mm^2/m$ similar to that of the KANTHAL™ wire, it has an excellent property as a heat wire material. Further, since the Fe-based amorphous thin plate (ribbon) is relatively more inexpensive than the KANTHAL™ wire, it is used as the material of the strip type surface heat emission element 13 in this invention.

However, if a material for the strip type surface heat emission element 13 has a specific resistance value that is not large and is required as a characteristic of a material for a heat wire, and is available inexpensively on market, any metal or alloy materials can be applied to the material for the strip type surface heat emission element 13.

Meanwhile, the amorphous thin plate (ribbon) is made for example by spraying fusible alloy of amorphous alloy in a cooling role that rotates at high speed by a liquid quenching technique, and cooling the fusible metal at a cooling rate of $10^6$ K/sec to then come off the cooled fusible metal, and is made of thickness of 10 to 50 μm and width of 20 to 200 mm. Also, the amorphous material has excellent material characteristics of high-strength, high corrosion-resistant and high soft magnetic properties generally. When a Fe-based amorphous ribbon is compared with a conventional silicon heater, there is an advantage that the former can be purchased as inexpensively with about ½ price as the latter.

As described above, the strip type surface heat emission element 13 according to this invention uses a metal thin plate of 10 to 50 μm as the heater material, and thus has a surface area of more than 10 to 20 times when compared with other coil style heat wires having an equal sectional area. Accordingly, when heat emission is attained by using equal electric power, low temperature heat emission is performed at a wide area, and thus the metal thin plate is suitable for a low temperature heating material. That is, because the strip type surface heat emission element 13 is made of a metal thin plate, a thermal density that happens per 1 $cm^2$ is low, and thus an amount of calorie is also low.

As a result, the strip type surface heat emission element 13 that is produced by processing a ribbon that is made of an amorphous thin plate in this invention does not need to form a heavy heat-proof property or insulation coating layer on the outer circumference of the heat emission element, considering relatively excess and/or high temperature thermogenesis, when compared with a coil style heat wire made of a conventional nichrome wire. Therefore, heat that is generated from the heat emission element can be transferred or delivered with high heat transfer efficiency.

Also, since the strip type surface heat emission element 13 according to this invention does not make surface temperature of the heater rise up to high temperature of 600~800° C. like a sheath heater and does not exceeds 170° C., there is no need to require a precise temperature control that uses an expensive controller. That is, in this invention, a defrost action can be achieved by a simple ON/OFF control of electric power applied to the surface heat emission element 13.

Moreover, when the surface heat emission element 13 according to this invention is made using an amorphous material, heat emission is attained lower by 100 or below than a boiling point of an environment-friendly refrigerant, to thus meet the UL recommendations.

However, if short-circuit happens partially in the heat emission element and thus temperature of the heater rises up above an ignition point of the environment-friendly refrigerant, the surface heat emission element material of amorphous alloy is crystallized to thereby be electrically cut off momentarily as if a fuse were cut off.

That is, since atoms are randomly oriented anarchically in an amorphous tissue in view of crystallography in metals, specific resistance appears very greatly, but crystallization proceeds. Accordingly, in the case of having a crystalline texture, the specific resistance is low. Also, in the case that the amorphous tissue is used as a thin film surface or linear heat emission element, electrical cutoff happens by heat emission that is produced by a high electric current flow.

As a result, the surface heat emission element made of an amorphous material according to this invention does not cause a fire by overheat, but loses a heater function, to thereby provide a new heater material that secures self-safety.

Meanwhile, the surface heat emission element 13 that is employed in this invention should be set to have a resistance value that is suitable for implementing a heater capacity of about 200 W so that heat emission may be attained within a range of a predetermined temperature and time that is needed for defrosting an evaporator for use in a refrigerator.

For this purpose, a material of the surface heat emission element 13 is a metal thin plate. Accordingly, for example, if predetermined width, length and area of a surface type defrost heater are decided according to size of an evaporator, an amorphous ribbon of broad width is slitted in a strip form having predetermined width.

Thereafter, predetermined overall length of the surface heat emission element that has been slitted by the predetermined width is cut into a number of surface heat emission elements 13*a*-13*c* having equal length according to width of the evaporator, and the number of the surface heat emission elements 13*a*-13*c* are connected by a series connection method as illustrated in FIG. 3, to thereby obtain a defrost heater 10*a* that has a desired heater capacity.

For example, the heater, that is, the strips 13*a*-13*c* used in the strip type surface heat emission element 13 according to this invention can be slitted to have width of 1-2 mm to thickness of 25 μm.

One end of first and second electrode terminals 15*a* and 15*b* is connected to a power plug through power cables 16*a* and 16*b*, respectively, and the other end thereof is spot welded or soldered at both ends of the strip type surface heat emission element 13, respectively. It is desirable that the connection portions are coated by an insert molding method using an insulation film so as to be sealed.

In addition, predetermined fuses (not shown) can be inserted between the other end of each of the first and second electrode terminals 15*a* and 15*b* and both ends of the strip type surface heat emission element 13, respectively. Accordingly, in the case that excess current flows by electric short, the fuses are cut, that is, electrically cut off. Of course these fuses can be used instead of other connection strips 13*e* and 13*f* that join the strips 13*a*, 13*b*, and 13*c*. Moreover, the strip type surface heat emission element 13 according to this invention does not allow surface temperature of the heater does not pass over 170° C. As a result, precise temperature control that uses an expensive controller is not only required but also a thermostat is used to shut off electric power in the case that surface temperature of the heater rises up above predetermined temperature to thereby secure safety, or natural electric cutoff can happen while crystallizing in the case that surface temperature of the heater rises up above crystallization temperature by using amorphous alloy as the surface heat emission element.

Meanwhile, an insulation layer 17 that is coated on the outer circumference of the strip type surface heat emission element 13 in a plate form is fixedly bonded on an aluminum heat transfer board 11 using an adhesive such as vanish or silicon. Synthetic resins having excellent heat resistance and electric insulation properties can be used as materials of the insulation layer 17 that is coated on the outer surface of the strip type surface heat emission element 13 to thus perform a moisture-proof, heatproof and electric insulation functions. For example, various film materials for electric insulation such as PE (polyethylene), PP (polypropylene), PET (Polyethylene Terephthalate) that is obtained by polymerizing TPA (Terephthalic Acid) and MEG (Mono-ethylene Glycol), polyimide, or silicon can be used as the materials of the insulation layer 17.

In general, the synthetic resins that are used as the materials of the insulation layer 17 are relatively cheap and have excellent characteristics in view of electric insulation, thermal stability, and water resistance. Silicon has also heat resistance, tensile strength, flexibility, and abrasion resistance. Therefore, since the insulation layer 17 of the above-described characteristics have been coated on the outer surface of strip type surface heat emission element 13, a short circuit phenomenon does not happen even under the high humidity environment, to thereby maintain safety.

The corrugation type radiation fin 19 as shown in FIGS. 5 and 6 is made of a material having an excellent heat transfer characteristic equally to that of the heat transfer board 11, is formed into a corrugation shape having repeatedly formed unevenness, and is attached on the other side surface of the aluminum heat transfer board 11.

A structure of combining a defrost heater according to the first embodiment of this invention with an evaporator of a refrigerator will be described below with reference to FIGS. 5 and 6.

First, when defrost heaters 10*a* according to this invention are attached on both sides of the evaporator 20 of the refrigerator having a structure where a number of fins 23 are vertically lengthily formed as shown in FIG. 5, to thereby enclose the whole horizontal line of a tube 21 that has been bent in a zigzag form and through which a refrigerant flows, the corrugation type radiation fin 19 is mutually in line contact with the fins 23 of the evaporator 20, as shown in FIG. 6. Here, in the case that a pair of the defrost heaters 10*a* are closely arranged in the evaporator 20, with a predetermined pressure, the corrugation type radiation fin 19 can contact all the evaporator fins 23 by the corrugation shape of the corrugation type radiation fin 19 although height of a number of the evaporator fins 23 may be inconsistent somewhat by an elastic force of the corrugation type radiation fin 19. As a result, heat delivered from the aluminum heat transfer board 11 can be effectively transferred to the fins 23 of the evaporator 2 without causing any thermal loss.

Therefore, in this invention, the defrost heaters 10*a* are in line contact with the number of the fins 23 to thereby transmit heat of the heater in a direct conduction method.

The defrost heater 10*a* according to the first embodiment of the present invention is manufactured via the following steps.

First, for example, a thin film amorphous ribbon or FeCrAl alloy thin plate is slitted in a pattern of strips 13*a*-13*c* that have a narrow width of 1-2 mm so as to have a predetermined resistance value and to form an overall length of a heat emission element lengthily in a series connection structure. Accordingly, a strip type surface heat emission element 13 is manufactured in a pattern that two electrode terminals are respectively formed on both sides of the strip type surface heat emission element 13.

Thereafter, an outer portion of the surface heat emission element 13 is coated in the lengthy direction thereof with a pair of insulation films, to thereby form an insulation layer 17, and then the surface heat emission element 13 that has been coated with the insulation films is attached on one side of an aluminum heat transfer board 11 by using an adhesive. Then, a corrugation type radiation fin 19 is attached on the other side of the aluminum heat transfer board 11. The final thickness of the defrost heater 10*a* that has been manufactured by using the corrugation type radiation fin 19 as described above is made less than 4.35 mm. However, in the case that no corrugation type radiation fin 19 is attached on the aluminum heat transfer board 11, thickness of the defrost heater 10*a* can be manufactured in a slim type of 1.35 mm or so.

A number of the defrost heaters 10*a* that have been constructed as described above are connected by a pair of coupling frames 21*a* and 21*b* with a predetermined space (S) as shown in FIG. 7 in proportion to an area of an evaporator for use in a refrigerator, to thereby form a single unit. That is, a number of the defrost heaters 10*a* can be used as a single unit. In this case, a number of the defrost heaters 10*a* are connected so that defrost heaters 10*a* that adjoin each other are connected through a jumper 23, and defrost heaters 10*a* that are arranged at both ends of the number of the defrost heaters 10*a* are connected with electric power cables 25*a* and 25*b*, respectively. In this manner, a proper number of the defrost heaters 10*a* according to the present invention can be connected according to capacity or size of the evaporator and used as a single unit.

Figure 8:
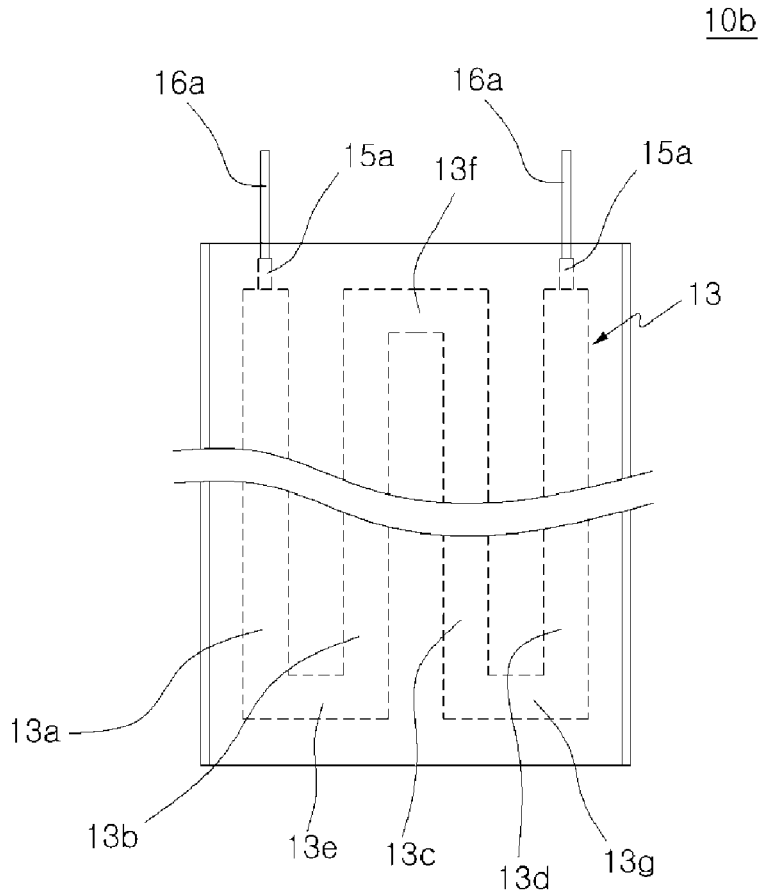
FIG. 8 is a plan view showing a defrost heater using a strip type surface heat emission element according to a second embodiment of this invention.

FIG. 8 is a plan view showing a defrost heater using a strip type surface heat emission element according to a second embodiment of this invention.

The defrost heater 10*b* according to the second embodiment of the present invention are equal in most of the components to the defrost heater 10*a* according to the first embodiment of the present invention. However, as shown in FIG. 8, an arrangement direction of first and second electrode terminals 15*a* and 15*b* that are connected at on both ends of the strip type surface heat emission element 13 differs from that of the defrost heater 10*a* according to the first embodiment of the present invention. That is, the first and second electrode terminals 15*a* and 15*b* are determined according to the number of strips 13*a*, 13*b*, and 13*c* whose arrangement direction runs in parallel each other. In the case that number of strips 13*a*, 13*b*, and 13*c* that have been disposed in parallel each other is odd as in the case of the defrost heater 10*a* of the first embodiment, the first and second electrode terminals 15*a* and 15*bs* are arranged in an opposite direction each other as shown in FIG. 3, but in the case that the number of the arranged strips is even as shown in FIG. 8, the first and second electrode terminals 15*a* and 15*bs* are arranged in an equal direction each other. This corresponds to the case that a number of strips 13*a*, 13*b*, and 13*c* are patterned in a series connection structure. Here, reference numerals 13*e*, 13*f*, and 13*g* in FIG. 8 denote connection strips, respectively.

Figure 9:
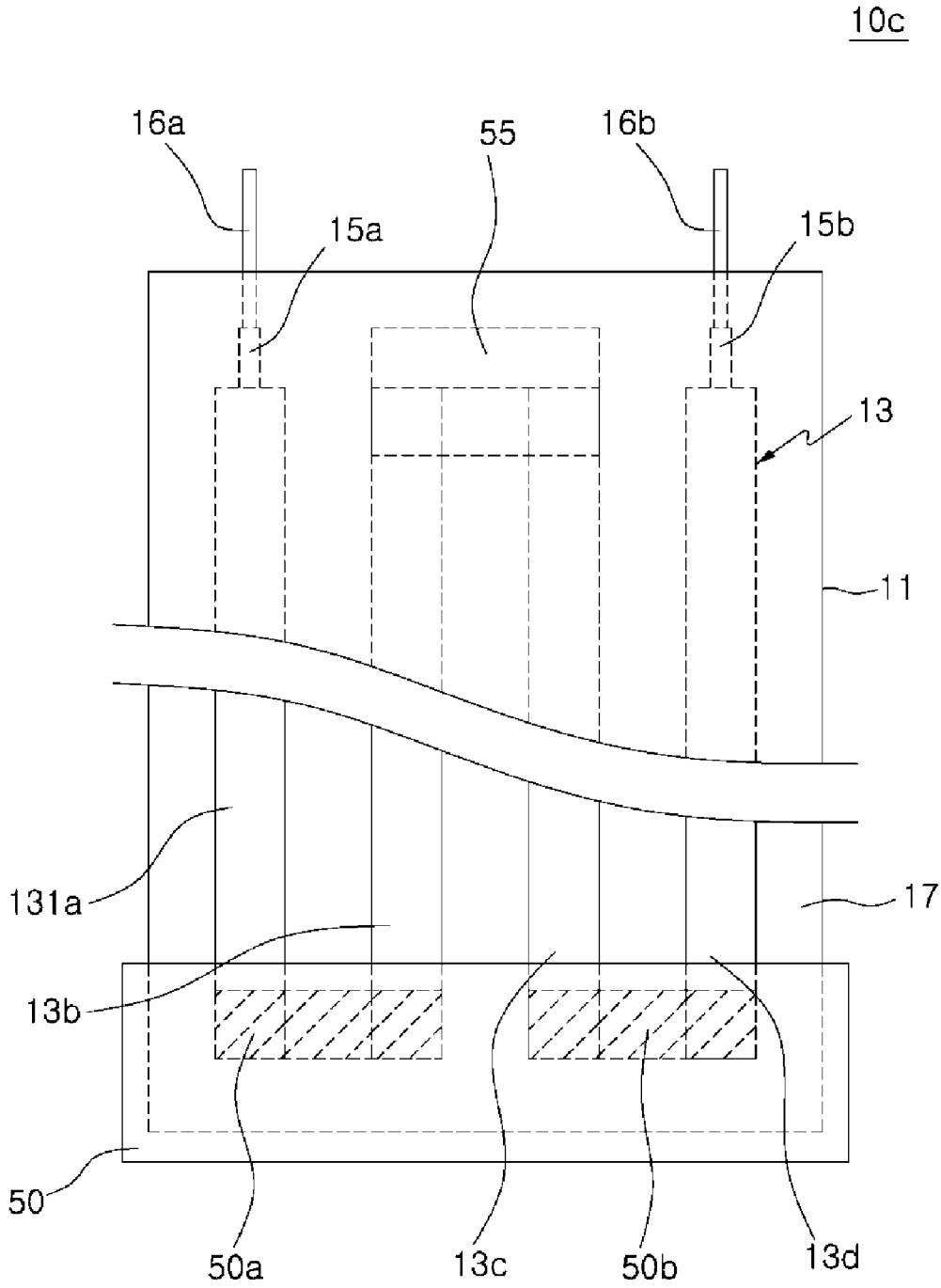
FIG. 9 is a plan view showing a defrost heater using a strip type surface heat emission element according to a third embodiment of this invention.
Figure 10:
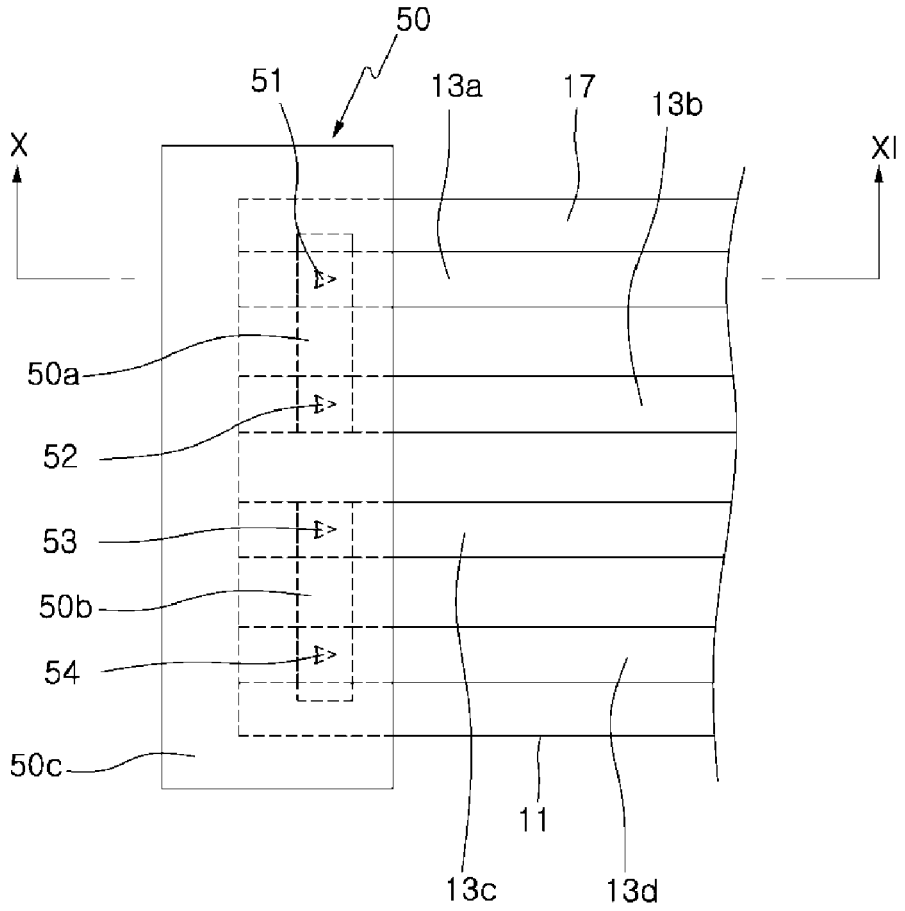
FIG. 10 is a detailed plan view showing a series connection unit of FIG. 9.
Figure 11:
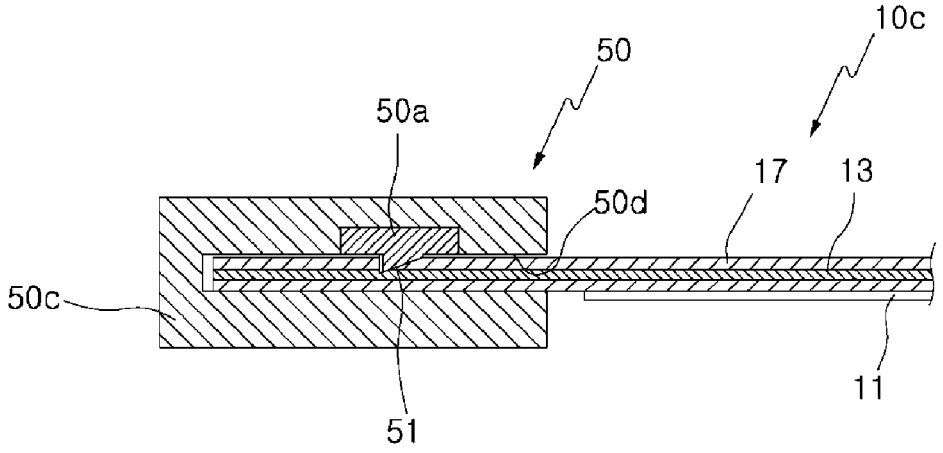
FIG. 11 is a cross-sectional view of the defrost heater cut along a line XI-XI of FIG. 10.

FIG. 9 is a plan view showing a defrost heater using a strip type surface heat emission element according to a third embodiment of this invention. FIG. 10 is a detailed plan view showing a series connection unit of FIG. 9. FIG. 11 is a cross-sectional view of the defrost heater cut along a line XI-XI of FIG. 10.

Referring to FIG. 9, a defrost heater 10*c* according to a third embodiment of the present invention is manufactured by the following steps.

A number of strips, for example, first to fourth strips 13*a*-13*d* that are four linear strips are manufactured. Thereafter, the ends of the second and third strips 13*b* and 13*c* are connected by using a bimetal thermostat 55, and an outer portion of the surface heat emission element 13 is coated to form an insulation layer 17. The ends of the first and second strips 13*a* and 13*b* are connected by a conductive coupling unit 50*a* of a series connection unit 50, and the ends of the third and fourth strips 13*c* and 13*d* are connected by a conductive coupling unit 50*b* of the series connection unit 50, to thereby form a structure of a series connected surface heat emission element 13 that equals to those of the first and second embodiments of the present invention.

As shown in FIGS. 10 and 11, the series connection units 50 has a structure of connecting the ends of the first and second strips 13*a* and 13*b* and connecting the ends of the third and fourth strips 13*c* and 13*d* in a manner that the series connection units 50 are simply fitted into the outer surface of the first and second strips 13*a* and 13*b* and the third and fourth strips 13*c* and 13*d* that are buried in the inside of the insulation layer 17, at a state where the insulation layer 17 has been formed on the outer surface of the surface heat emission element 13. That is, the series connection unit 50 has a structure that conductive connection joints 50*a* and 50*b* that connect the adjoining first and second strips 13*a* and 13*b* and the adjoining third and fourth strips 13*c* and 13*d*, respectively, are integrally formed on the upper surface of a groove in a housing 50*c* having a structure of a rectangular groove 50*d*. The respective conductive connection joints 50*a* and 50*b* have four stoppers 51-54 whose leading ends are sharp-pointed and that are integrally protrudingly formed toward the groove from an entrance side, in correspondence to the first and second strips 13*a* and 13*b* and the third and fourth strips 13*c* and 13*d*.

Therefore, a heater that is formed by forming the insulation layer 17 on the outer surface of the surface heat emission element 13 is inserted into the groove 50*d* of the series connection unit 50, and then retreated by a bit of length. In this case, the stoppers 51 and 52 of the conductive connection joint 50*a* penetrate into the insulation layer 17 and are connected with the first and second strips 13*a* and 13*b*, so that the first and second strips 13*a* and 13*b* can be connected in series, and the stoppers 53 and 54 of the conductive connection joint 50*b* penetrate into the insulation layer 17 and are connected with the third and fourth strips 13*c* and 13*d* so that the third and fourth strips 13*c* and 13*d* can be connected in series. Here, the heater is not retreated by impediment of the stoppers 51-54.

In this case, a bimetal thermostat 55 can be connected in series instead of the series connection unit 50. If ambient temperature rises up above predetermined temperature, the electric power supply that is applied to the first and second electrode terminals 15*a* and 15*b* is automatically cut off. To contrary, if ambient temperature falls down below predetermined temperature, the electric power supply is automatically applied to the first and second electrode terminals 15*a* and 15*b*.

As described above, the electric power supply is applied to the heat emission element 13 only within a certain range of temperature, in the case that an electric current interception unit such as the bimetal thermostat or fuse is provided between any one of the first and second electrode terminals 15*a* and 15*b* and the heat emission element 13. That is, the bimetal thermostat is turned off or the fuse is melted in the case that excessive current flows, to thereby cut off the electric power supply and thus prevent fire.

Figure 12:
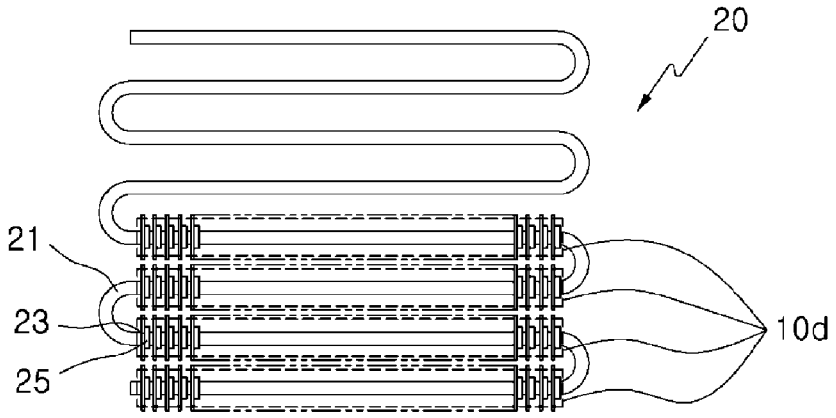
FIG. 12 is a front view illustrating a state where a defrost heater according to this invention is applied to an evaporator of a refrigerator.

FIG. 12 is a front view illustrating a state where a defrost heater according to this invention is applied to an evaporator of a refrigerator.

An evaporator 20 of a refrigerator that is illustrated in FIG. 12 has a structure that a number of fins 23 are combined in every horizontal line so as to enclose a tube 21 through which a refrigerant flows and that is bent in a zigzag form in every horizontal line.

A number of defrost heaters 10*d* according to an embodiment of this invention are respectively installed in correspondence to the front and rear surfaces of the evaporator 20 in each horizontal line, and a radiation fin 19 is in line contact with the number of the fins 23 through which the tube 21 of the evaporator 20 passes, to thereby transmit heat of the heater by a direct conduction method.

Since the number of the defrost heaters 10*d* according to the embodiment of this invention are respectively installed in correspondence to the front and rear surfaces of the evaporator 20 in each horizontal line, the defrost heater 10*d* shown in FIG. 12 has the same structure as that of the defrost heater 10*a* shown in FIG. 3, except that the number of the strips included in the surface heat emission element of FIG. 12 is smaller than that of the strips 13*a*-13*c* of FIG. 3, and width of the defrost heater 10*d* of FIG. 12 is narrower than that of the defrost heater 10*a* of FIG. 3, when the defrost heater 10*d* of FIG. 12 is compared with the defrost heater 10*a* of FIG. 3.

The defrost heaters 10*d* are identical with the defrost heater 10*a* according to the embodiment that is illustrated in FIG. 3, except a point that the defrost heaters 10*d* is made into a number of sectioned defrost heaters. The defrost heaters 10*d* are in line contact with a number of evaporator fins 23. Accordingly, heat generated from the strip type surface heat emission element 13 is smoothly transmitted and heat transferred to the number of the evaporator fins 23 is transferred to the tube 21 of the evaporator 20.

Therefore, the defrost heaters can transfer heat that is produced in the strip type surface heat emission element 13 evenly without causing any loss to the tube 21 of the evaporator 20 through the number of the fins 23 in the corrugation type radiation fin 19, to thereby improve a defrost efficiency and decrease electric power consumption.

In addition, the defrost heater according to the illustrated embodiment of the present invention uses the strip type surface heat emission element 13 that is obtained by slitting a metal thin film, as a heat source. Accordingly, if a defrost cycle starts and electric power is supplied for the defrost heater, temperature of the surface heat emission element 13 of the metal thin film whose temperature response performance is fast rises up quickly to predetermined temperature, to thereby melt frost deposited on the surface of the evaporator 20. If ambient temperature descends down to predetermined temperature or below through the bimetal thermostat 55 or a temperature sensor, the electric power supply is cut off for the surface heat emission element 13, and thus temperature of the surface heat emission element 13 is quickly descended. As a result, a refrigerator or refrigerating apparatus can resume a refrigerating cycle quickly, and thus a freezing performance that has fallen due to the defrost cycle can be recovered fast, to thereby preserve various kinds of storage goods at a set state in the refrigerator or refrigerating apparatus.

Figure 13:
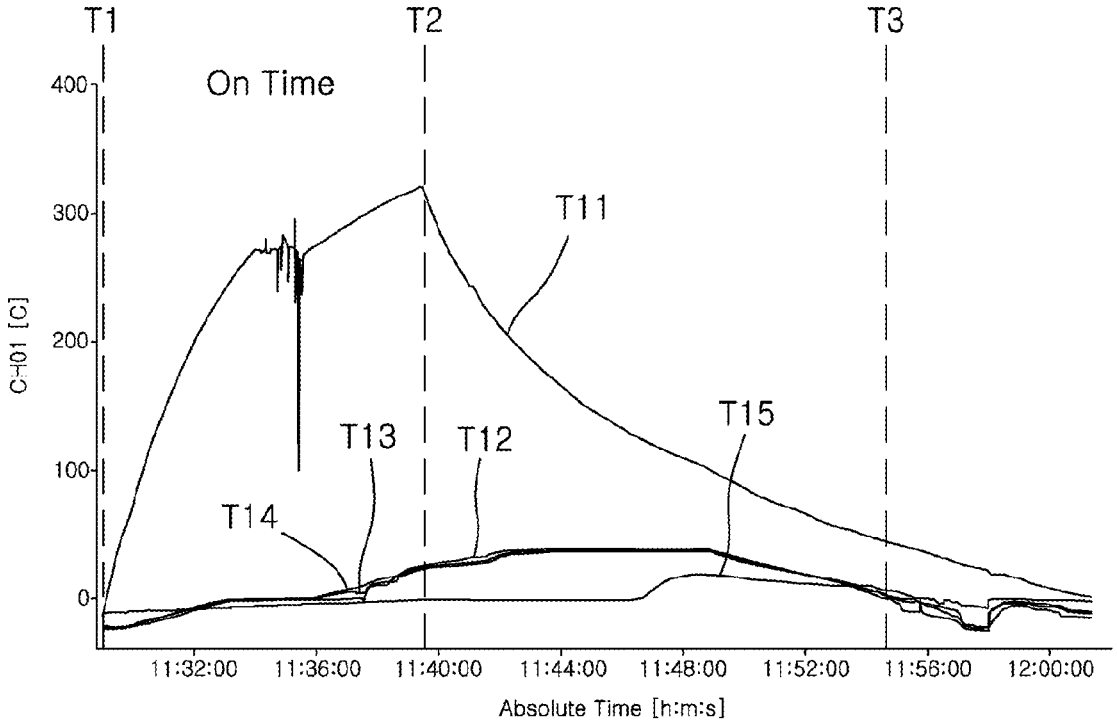
FIG. 13 is a graphical view showing a defrost cycle of a conventional defrost heater that performs defrost by using convection through a sheath heater.
Figure 14:
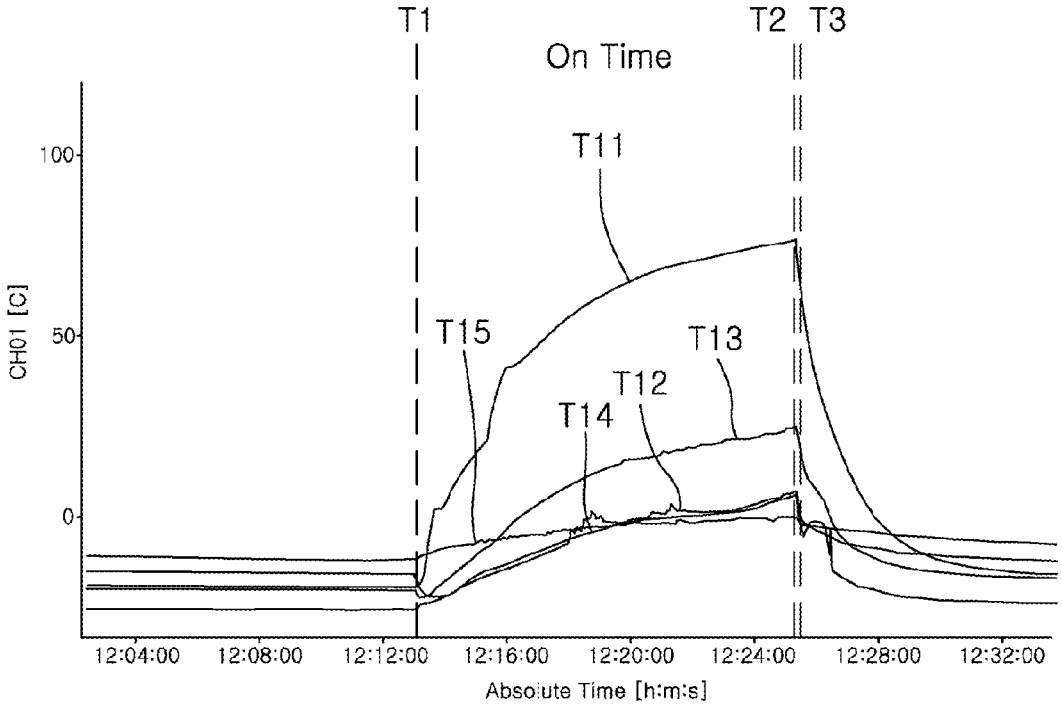
FIGS. 14 to 16 are graphical views showing a defrost cycle in the case that electric power wattage of a defrost heater according to an embodiment of this invention is set to 100 watt, 120 watt, and 180 watt, respectively.
Figure 15:
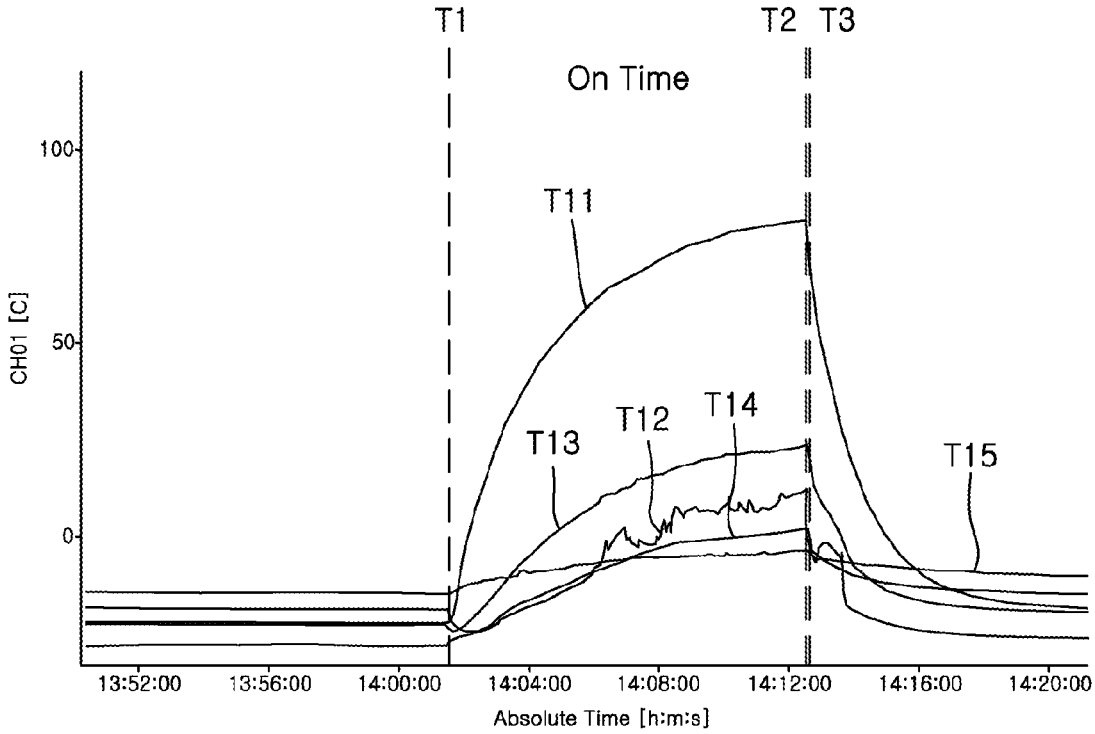
Figure 16:
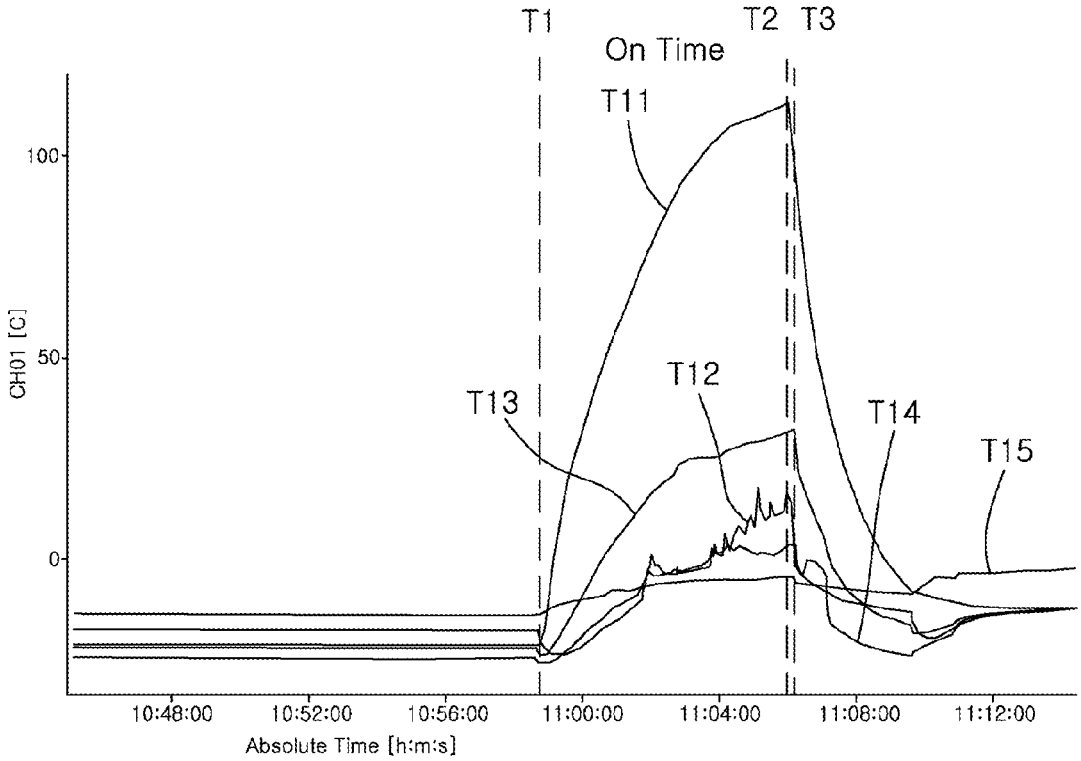

FIG. 13 is a graphical view showing a defrost cycle of a conventional defrost heater that performs defrost by using convection through a sheath heater. FIGS. 14 to 16 are graphical views showing a defrost cycle in the case that electric power wattage of a defrost heater according to an embodiment of this invention is set to 100 watt, 120 watt, and 180 watt, respectively.

Referring to graphs of FIGS. 13 to 16 showing temperature of respective portions during performing defrost cycles of the conventional defrost heater and the present invention defrost heater together with the following Table 1, the defrost cycles of the defrost heaters will be described below.

TABLE 1

| | Conventional (225 watt) | | Present invention (100 watt) | | Present invention (120 watt) | | Present invention (180 watt) | |
|---|---|---|---|---|---|---|---|---|
| | Before defrost | During defrost | Before defrost | During defrost | Before defrost | During defrost | Before defrost | During defrost |
| Heater surface temperature (T11) | −12.9 | 321 | −19.1 | 75.4 | −21.8 | 87.7 | −21.7 | 112.9 |
| Evaporator fin temperature (T13) | −20.9 | 38.6 | −19.5 | 25.0 | −22.5 | 23.8 | −21.1 | 32.3 |
| Space temperature between evaporator fins (T12) | −21.0 | 39.7 | −15.4 | 7.5 | −18.2 | 11.7 | −17.4 | 14.7 |
| Evaporator tube temperature (T14) | −22.6 | 38.0 | −25.1 | 6.7 | −28.1 | 2.5 | −24.3 | 3.4 |
| Refrigerator room temperature (T15) | −10 | −0.1 | −11.1 | 0.3 | −14.4 | −3.3 | −13.3 | −3.8 |
| Consumed time | 12 minutes | 18 minutes | 9 minutes | 1 minute | 9 minutes | 1 minute | 6 minutes | 1 minute |

In the Table 1, temperature is expressed as ° C.

First, when a conventional defrost heater is used, and in a heater running interval from T1 at which a blower fan is turned off and a defrost heater is turned on to T2 at which the blower fan is turned on and the defrost heater is turned off, the heater surface temperature T11 at a point in time T2 is 321 and consumed time from T1 to T2 was about 12 minutes, as shown in FIG. 13.

Meanwhile, when the defrost heater according to this invention is used, the heater surface temperature T11 at the T2 point in time of 100 watt, 120 watt, and 180 watt heaters is 75.4° C., 87.7° C., and 112.9° C., respectively, and consumed time from T1 to T2 were 9 minutes, 8 minutes, and 6 minutes, respectively. That is, heater running time consumed from T1 to T2 in the conventional defrost heater was longer by at minimum 3 minutes or at maximum 6 minutes than that of the defrost heater according to this invention. The temperature of the conventional defrost heater was maintained higher by at minimum 208.1° C. or at maximum 245.6° C., that is, by 200° C. or higher than that of the defrost heater according to this invention.

As it can be seen from FIGS. 13 to 16, since the conventional defrost heater employs an air heating method and uses a sheath heater whose temperature response performance is slow, temperature rising time was long, but since the defrost heater according to this invention uses the surface heater whose temperature response performance is fast, the temperature rising time was short by a direct conduction method.

As a result, although a compressor operates after electric power supply for the conventional defrost heater has been turned off, in the conventional defrost heater, space temperature (T12) between evaporator fins, evaporator fin temperature (T13), and evaporator tube temperature (T14) rose up to about 39° C. and were kept at this temperature for a long time, and then descended. Immediately after a compressor operates after electric power supply for the defrost heater according to the present invention has been turned off, in the defrost heater according to the present invention, it can be seen that space temperature (T12) between evaporator fins and evaporator tube temperature (T14) started to descend and fall down to 0° C. within 1 minute, and evaporator fin temperature (T13) also descended down to 0° C. within 2-3 minutes.

Also, the conventional defrost heater has an interval where refrigerator room temperature (T15) rose up to 0° C. or higher after defrost, but the defrost heater according to the present invention has no interval where refrigerator room temperature (T15) rises up to 0° C. or higher after defrost and remains below zero. Accordingly, freshness of goods stored in a refrigerating room or cold-storage room can be prevented from being lowered.

Moreover, since the heater surface temperature (T11) was high as 321 in the conventional defrost heater as described above, temperature of the heater should be controlled in order to use an environmental-friendly refrigerant whose ignition point is low, for example, R600a (refrigerant boiling point: 460° C.). This is because fire can occur at a temperature of the refrigerant boiling point minus 100° C., that is, at 360° C. or higher. On the contrary, since maximum rise temperature (about 113° C.) of the heater surface for defrost was lower than the ignition point of the refrigerant in case of using the defrost heater according to this invention, there is an advantage that temperature control of the heater is unnecessary.

Meanwhile, when using the conventional defrost heater, time that is consumed from T2 to T3 points in time, that is, from time at which defrost is ended to time (that is, a point in time at which temperature descends down to 0° C.) at which defrost is converted into refrigerating, was about 18 minutes in which temperature of the evaporator tube was set as a reference. But, when using the defrost heater according to the present invention, time that is consumed from T2 to T3 points in time was less 1 minute. Finally, one cycle for defrost (heater running time for defrost and time that is taken for the evaporator tube descends down to 0° C. after having run a compressor after completion of defrost) in the conventional defrost heater required total 30 minutes, but the defrost heaters according to the present invention required one cycle for defrost of 10 minutes, 9 minutes, and 7 minutes, respectively. Thus, it has been confirmed that the time that is consumed for one cycle of the defrost heater according to the present invention can be shortened by about one thirds or lower than that of the conventional defrost heater.

Therefore, this invention can reduce the defrost cycle greatly in comparison with the conventional defrost heater. As a result, a refrigerator or refrigerating apparatus employing the defrost heater according to the present invention can resume a refrigerating cycle speedily, and thus the refrigerating performance that has been lowered due to the defrost cycle can be recovered quickly.

The evaporator of the refrigerator has been described as an example in the above-described first to third embodiments, but it is apparent for one skilled in the art that the present invention can be applied to industrial or household refrigerating apparatuses or facilities adopting any evaporator that requires for the defrost cycle.

Figure 17:
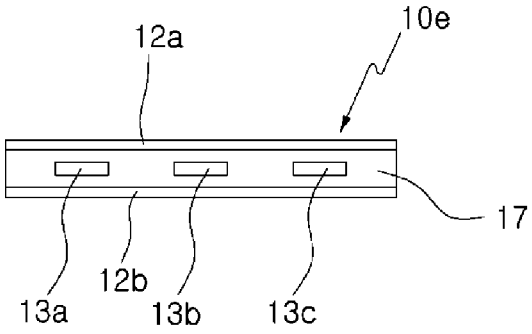
FIG. 17 is a cross-sectional view showing a defrost heater using a strip type surface heat emission element according to a fourth embodiment of this invention.
Figure 18:
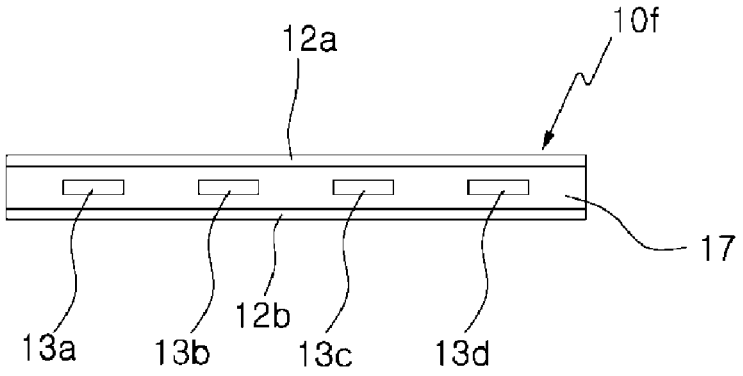
FIG. 18 is a cross-sectional view showing a defrost heater using a strip type surface heat emission element according to a fifth embodiment of this invention.

FIGS. 17 and 18 are a cross-sectional view respectively showing a defrost heater using a strip type surface heat emission element according to fourth and fifth embodiments of this invention.

Referring to FIGS. 17 and 18, the defrost heaters 10*e* and 10*e* that use strip type surface heat emission elements according to the fourth and fifth embodiments of this invention include: a strip type surface heat emission element 13 that performs heat emission when electric power is applied to both ends of respective strips, in which a number of strips 13*a*-13*d* are arranged in parallel at intervals and both ends of the respective adjoining strips are mutually connected by a series or parallel connection method; an insulation layer 17 that is coated on the outer circumference of the strip type surface heat emission element 13 in the form of a plate; and first and second heat transfer boards 12*a* and 12*b* that are respectively attached to the upper and lower portions of the insulation layer 17 and radiate heat generated from the strip type surface heat emission element 13 to the outside.

In the case that the respective strips 13*a*-13*d* are connected in series, both ends of two adjoining strips among the respective strips 13*a*-13*d* are connected with the integrated connection joints 13*e* and 13*f*, as in the fourth and fifth embodiments of the present invention, or are mutually connected by using the series connection unit 50 as in the third embodiment of the present invention.

The defrost heaters 10*e* and 10*f* according to the fourth and fifth embodiments of the present invention differ from the defrost heaters 10*a* and 10*b* according to the first and second embodiments of the present invention, only in view of structure of the heat transfer board, but the former equals the latter in view of the strip type surface heat emission element 13 and the insulation layer 17.

The first and second heat transfer boards 12*a* and 12*b* are formed of at least one of Cu, Ag, Au and Al whose heat transfer characteristic is excellent, in the fourth and fifth embodiments of the present invention. In this case, because fins of the evaporator are desirably made of Al whose heat transfer characteristic (that is, heat radiation characteristic) is excellent, first and second heat transfer boards 12*a* and 12*b* are also made of Al. It is desirable that the first and second heat transfer boards 12*a* and 12*b* should use a material that Al alloy made of Al-5% Si is hot rolling joined with an Al base so that the first and second heat transfer boards 12*a* and 12*b* can be brazing welded to the evaporator fins made of Al.

Figure 19:
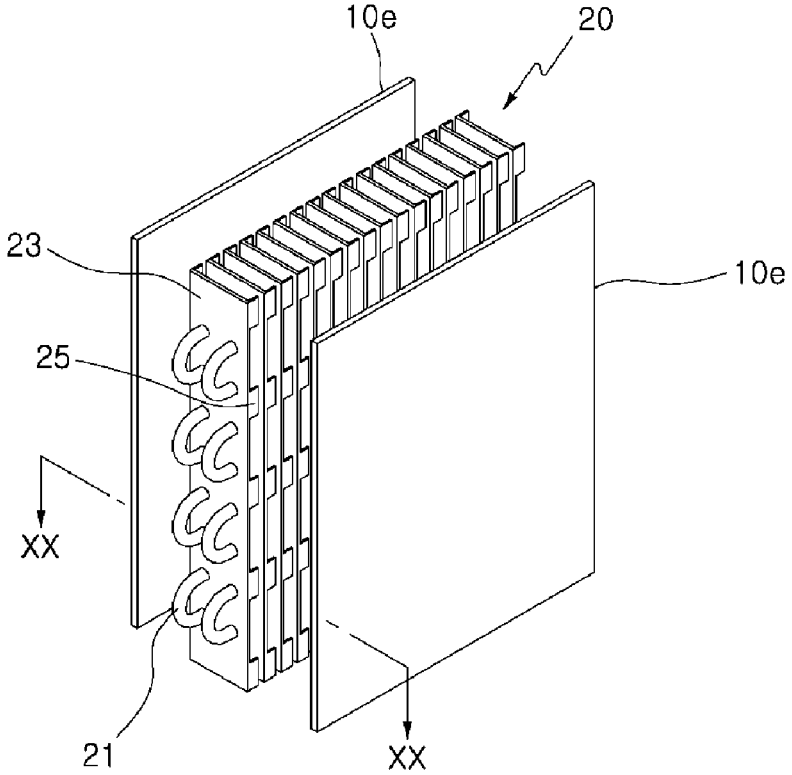
FIG. 19 is a perspective view illustrating a state where a defrost heater according to the fourth embodiment of this invention is applied to an evaporator of a refrigerator.
Figure 20:
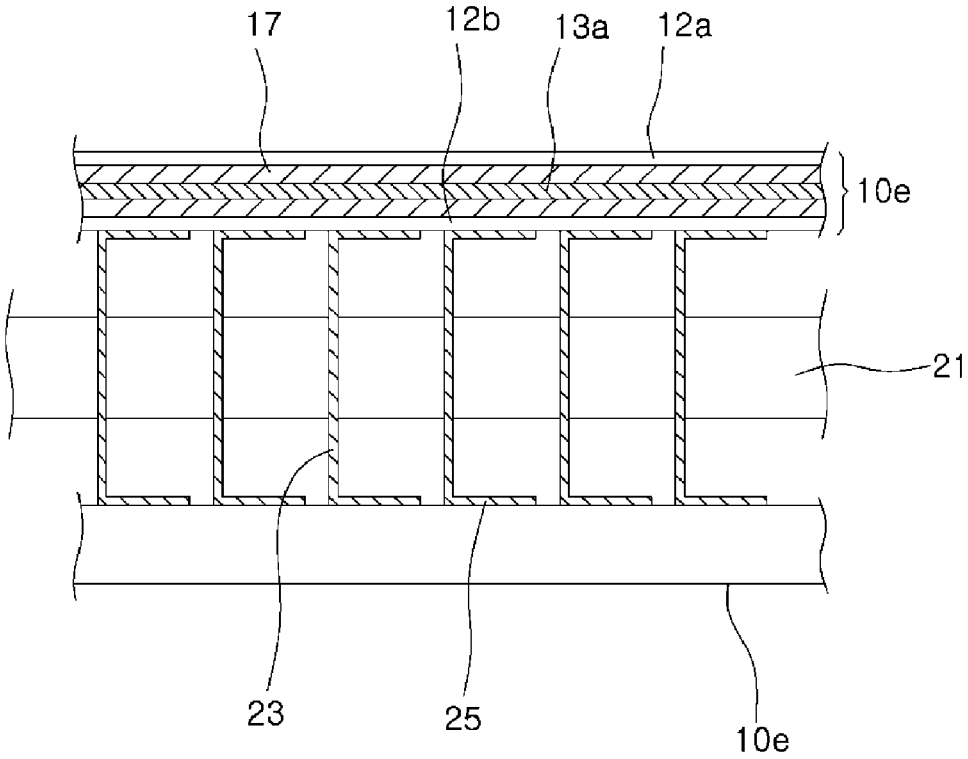
FIG. 20 is a partial cross-sectional view of the defrost heater cut along a line XX-XX of FIG. 19.

FIG. 19 is a perspective view illustrating a state where a defrost heater according to the fourth embodiment of this invention is applied to an evaporator of a refrigerator. FIG. 20 is a partial cross-sectional view of the defrost heater cut along a line XX-XX of FIG. 19.

An evaporator 20 of a refrigerator employing defrost heaters 10*e* according to a fourth embodiment of the present invention have a structure that a number of fins 23 are lengthily formed in a vertical direction so as to enclose the whole horizontal line of a tube 21 through which a refrigerant flows and that is bent in a zigzag form. Each fin 23 has a structure that a number of extension portion 25 are extended from front and rear sides of each fin with a predetermined interval.

The defrost heaters 10*e* according to the fourth embodiment of the present invention is formed of one pair and are installed on the front and rear surfaces of the evaporator 20, respectively. Any one of first and second heat transfer boards 12*a* and 12*b* is brazing welded or bonded using an adhesive on the extension portions 25 of the number of the fins 23 that are formed to make the tube 21 of the evaporator 20 pass through the fins 23. Here, the extension portions 25 are bent so that the number of the fins 23 run in parallel with the evaporator 20, and are closely placed from the adjoining fins 23. Therefore, the number of the extension portions 25 form a shape that a flat surface has a slit.

Hereupon, the defrost heater 10*e* according to this invention has a structure that any one of the first and second heat transfer boards 12*a* and 12*b* are evenly on the whole surface of the number of the extension portions 25. Here, since the defrost heater is in area contact with the number of extension portions 25 in a wide area, heat that is produced in the strip type surface heat emission element 13 is effectively transmitted, and heat transmitted to the number of the extension portions 25 is transferred to the tube 21 of the evaporator 20 through the respective fins 23.

Therefore, the defrost heater according to the present invention equally transfers heat generated from a strip type metal thin film surface heat emission element 13 to the evaporator 20 via the number of the fins 23 having the extension portions 25 in any one of the first and second heat transfer boards 12*a* and 12*b* without causing any loss, to thereby maximize a defrost efficiency and decrease electric power consumption.

Figure 21:
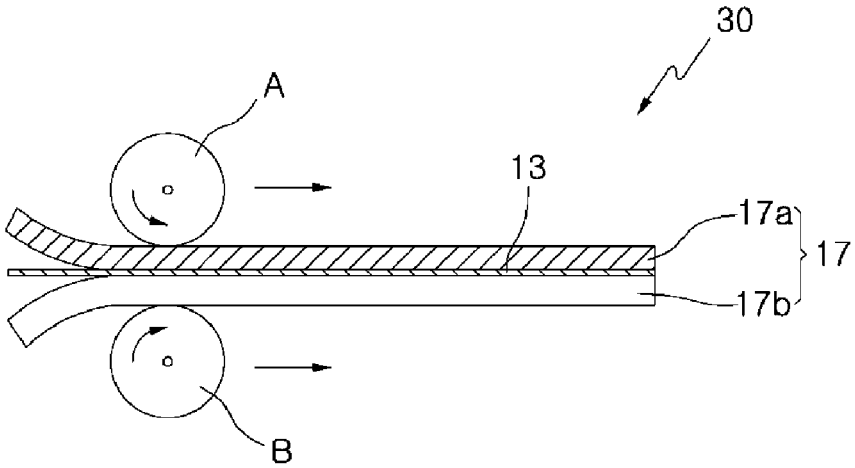
FIGS. 21 to 23 are cross-sectional views for explaining a method of manufacturing a defrost heater using a strip type surface heat emission element according to a sixth embodiment of this invention, respectively.
Figure 22:
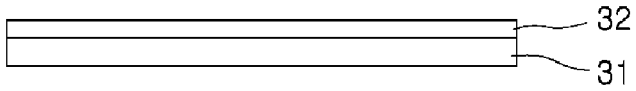
Figure 23:
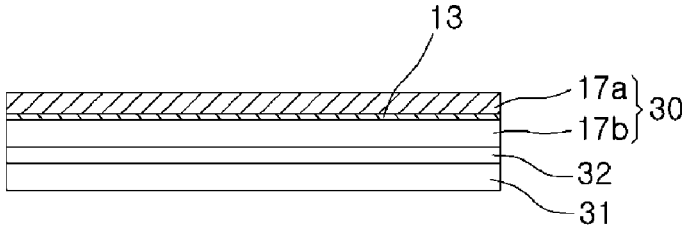

FIGS. 21 to 23 are cross-sectional views for explaining a method of manufacturing a defrost heater using a strip type surface heat emission element according to a sixth embodiment of this invention, respectively.

First, a strip type surface heat emission element is prepared. For example, as described above, the strip type surface heat emission element is prepared in a manner that a thin film amorphous ribbon or FeCrAl alloy thin plate is slitted in a pattern of strips (13*a*-13*c* of FIG. 3) that have a width of 1-2 mm so as to have a predetermined resistance value and to form an overall length of the heat emission element lengthily in a series connection structure. Accordingly, a strip type surface heat emission element 13 is manufactured in a pattern that two electrode terminals are respectively formed on both sides of the strip type surface heat emission element 13.

As illustrated in FIG. 21, as an available insulation material, PET (Polyethylene Terephthalate) films 17*a* and 17*b* that are insulation materials are arranged on top and bottom of the surface heat emission element 13. Then, the surface heat emission element 13 is laminated in order to coat the PET films 17*a* and 17*b* on top and bottom thereof, using heater built-in silicon rollers A and B.

That is, if the PET films 17*a* and 17*b* forming an insulation layer 17 are overlapped on top and bottom of the surface heat emission element 13, and then are passed through the silicon rollers A and B that are set for example to be 100-200° C., a heater assembly 30 can be obtained. Thickness of the heater assembly 30 is 0.30 mm desirably.

Here, the PET films have been used as the material of the insulation layer 17 that has been coated on the outer surface of the strip type surface heat emission element 13, to thereby perform moisture-proof, heatproof and electric insulation functions in this embodiment, but synthetic resin whose heat resistance and electric insulation are excellent can be used. For example, various kinds of film materials for electric insulation such as PE (Polyethylene), PP (Polypropylene), polyimide, or silicon can be used as the material of the insulation layer 17.

The surface heat emission element 13 on which the PET films are coated as the insulation layer by such a laminating method should be deposited on the heat transfer board, in order to transfer heat evenly. The heat transfer board can be formed of one of Al, Cu, Ag and Au or an alloy material thereof, whose heat transfer characteristic is excellent. In this embodiment, aluminum has been used. In this case, the aluminum heat transfer board is anodized to thereby form an insulator film for oxidation prevention and electrical insulation on the surface thereof. Referring to FIG. 22, for example an insulation layer 32 that plays a role of an adhesion and insulating material such as silicon varnish is deposited on the upper portion of the aluminum heat transfer board 31. Then, as illustrate in FIG. 23, the heater assembly 30 is bonded on the insulation layer 32. Thus, thickness of the finally made defrost heater 35*a* is 1.40 mm desirably.

Figure 24:
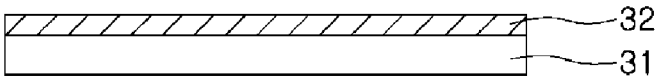
FIGS. 24 to 26 are cross-sectional views for explaining a method of manufacturing a defrost heater using a strip type surface heat emission element according to a seventh embodiment of this invention, respectively.
Figure 25:
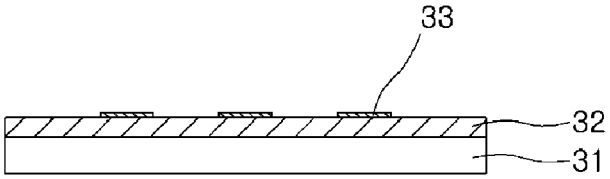
Figure 26:
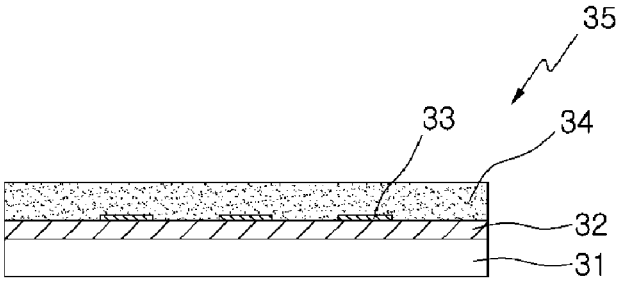

FIGS. 24 to 26 are cross-sectional views for explaining a method of manufacturing a defrost heater using a strip type surface heat emission element according to a seventh embodiment of this invention, respectively.

First, a metal thin film is slitted by the above-described method, and thus a number of surface heat emission elements 33 as shown in FIG. 3 or 9 are prepared. A heat transfer board 31 for transferring heat and supporting a surface heat emission element is also prepared. The heat transfer board 31 plays a role of evenly transferring heat generated from the surface heat emission elements 33 can be formed of one of Al, Cu, Ag and Au or an alloy material thereof, whose heat transfer characteristic is excellent. In this embodiment, aluminum has been used. In this case, the aluminum heat transfer board is anodized to thereby form an insulator film for oxidation prevention and electrical insulation on the surface thereof.

If the aluminum heat transfer board 31 has been completely prepared, a first insulation layer 32 is coated on the heat transfer board 31 as illustrated in FIG. 24. The first insulation layer 32 is formed on the aluminum heat transfer board 31 by a dipping coating method using an insulation adhesive such as silicon varnish. The silicon varnish has a strong adhesive strength when it is in a semi-hardened state after application. Here, thickness of the first insulation layer 32 is desirably set according to a voltage environment where a heater is used. Thickness of the first insulation layer 32 is preferably 10-100 micrometers, and the thickness thereof is 50 micrometers most preferably. Here, if thickness of the first insulation layer is so thin as 10 micrometers or below, an insulation problem may happen, and if thickness of the first insulation layer is so thick as 100 micrometers or above, heat conductivity decreases.

If the first insulation layer 32 has been completely coated on the upper portion of the aluminum heat transfer board 31, one or a number of surface heat emission elements 33 are arranged as illustrated in FIG. 25. The surface heat emission element 33 has the same shape and function as that of the mutually connected zigzag shaped integrated surface heat emission element 13 of FIG. 3 or a number of the strip type surface heat emission elements 33 of FIG. 9.

If the surface heat emission element 33 is arranged and then bonded on the upper portion of the first insulation layer 32, a second insulation layer 34 is formed on the upper portion of the first insulation layer 32 and the surface heat emission element 33 above the aluminum board 31 by a dipping coating method, as illustrated in FIG. 26.

The second insulation layer 34 is also bonded using an insulation adhesive such as silicon varnish in the same manner as that of the first insulation layer 32. Here, the second insulation layer 34 is preferably coated with a thickness of 1 millimeter to 100 micrometers. Most preferably, the second insulation layer 34 is coated with a thickness of 300-400 micrometers. It is possible that other materials except silicon varnish are used as the insulation material of the first and second insulation layers 32 and 34.

The example of forming the insulation layers by using silicon varnish has been described in the embodiment of the present invention, but the insulation layers can be formed by a Teflon coating or plasma coating method. In the case of the plasma coating, a nano-size inorganic coating material or ceramic material can be coated as the insulation material. The outer surface of the strip type surface heat emission element 33 can be coated by the first insulation layer 32 and the second insulation layer 34 to thereby have moisture-proof, heatproof and electric insulation functions. Thickness of the finally produced defrost heater 35 in the seventh embodiment of the present invention is 1.50 mm.

Figure 27:
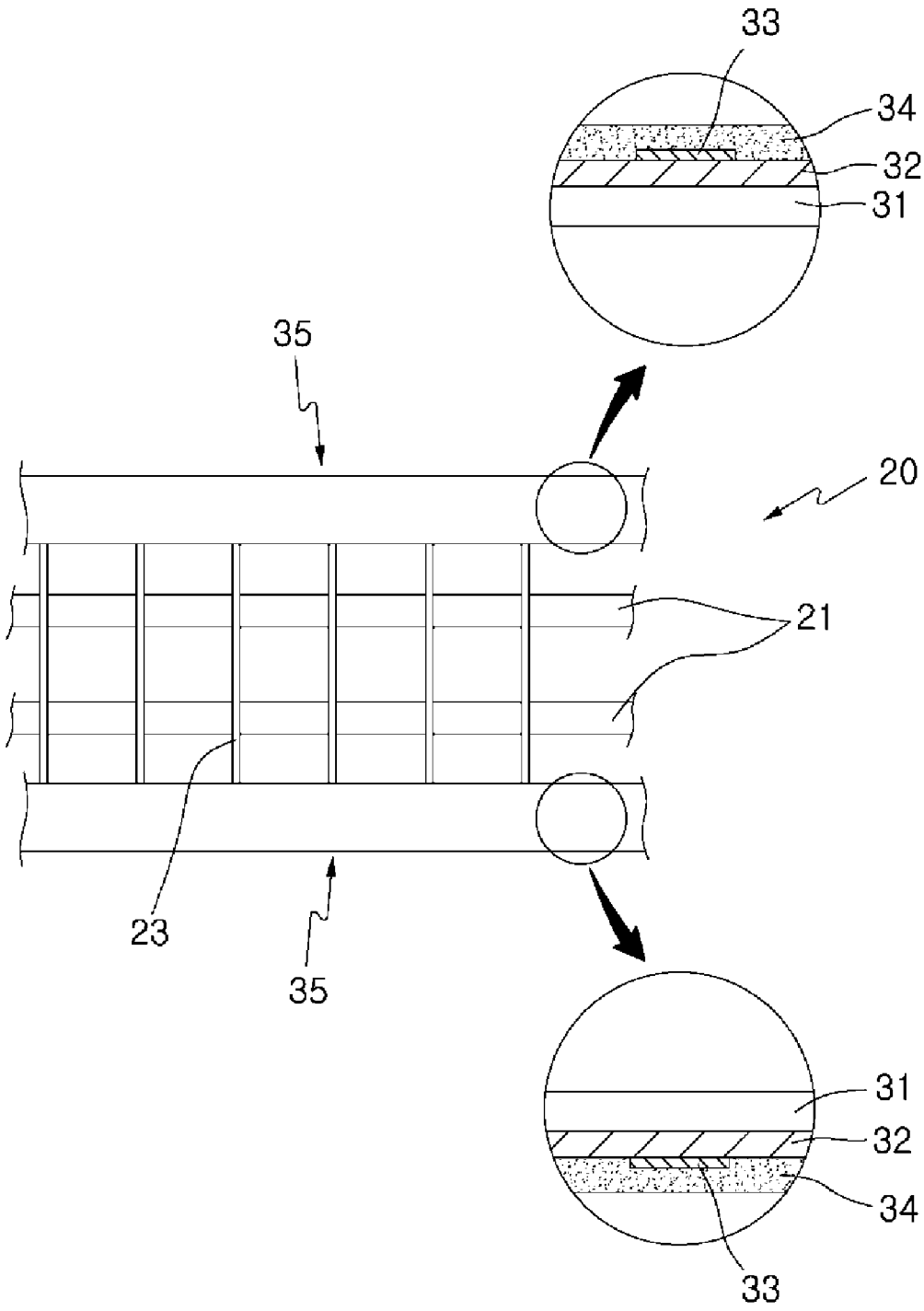
FIG. 27 is a plan view showing a defrost apparatus using the defrost heater according to the seventh embodiment of the present invention.

Here, when a pair of the defrost heaters 35 are used as a defrost apparatus, the second insulation layers 34 are installed at the rear side of a refrigerator and the aluminum heat transfer boards 31 are installed to contact in opposition to the evaporator 20, as illustrated in FIG. 27. The aluminum heat transfer boards 31 are disposed on the contact surfaces with respect to the fins 33 in both the defrost heaters 35. The defrost heaters 35 closely contact each other to oppose each other.

If the pair of the defrost heaters 35 are arranged in the defrost apparatus, heat that is produced from the surface heat emission element 33 during performing a defrost action, is transferred to the aluminum heat transfer boards 31 whose heat transfer characteristic is excellent via the thin film first insulation layer 32, to then be transferred at uniform temperature to the upper and lower parts and the left and right parts of the aluminum heat transfer boards 31. Therefore, heat is transferred to a number of evaporator fins 23 of the evaporator 20 via the uniform temperature aluminum heat transfer boards 31, to thereby enable a uniform defrost operation.

In this case, since the second insulation layer 34 of thick film encloses the back of the surface heat emission element 33 in comparison with the first insulation layer 32 of thin film, the second insulation layer 34 of thick film plays a role of a thermal isolation layer. As a result, heat that is produced from the surface heat emission element 33 during performing a defrost action is transferred to the aluminum heat transfer boards 31 via the first insulation layer 32 of thin film mainly, to thereby heighten a thermal conduction efficiency and minimize a rise of temperature of a cold-storage room through refrigerator walls.

The defrost apparatus according to this embodiment of the present invention has short temperature rising time that is taken to reach the maximum rising temperature of the heater when a defrost action is started similarly to that of the above-described embodiment of the present invention, and reduces a running time at a re-activation point in time of a compressor after having completed the defrost action, to thereby minimize a reset time to return to the refrigerating cycle. That is, immediately after the defrost action has been completed, electric power of the defrost heater is turned off and the compressor is operated. Accordingly, cooling time that is taken to cool temperature of the refrigerant tube is low to a point in time when a refrigerating cycle of the refrigerating apparatus is substantially re-activated, that is, 0° C., is shortened (that is, a temperature response performance of the heater is fast), the overall defrost cycle is shortened. As a result, there is an advantage that the defrost cycle is converted into a refrigerating cycle immediately after defrost. In addition, since the maximum rising temperature of the heater surface is about 113° C. in this embodiment of the present invention, the maximum rising temperature of the heater surface is remarkably lower than ignition point of the refrigerant. Thus, there is an advantage that temperature control of the heater is unnecessary.

Hereinbelow, the structure that the defrost apparatus using the defrost heater of the seventh embodiment that is illustrated in FIG. 26 has been mounted in the evaporator of the refrigerator will be described with reference to FIGS. 28 to 32.

Figure 28:
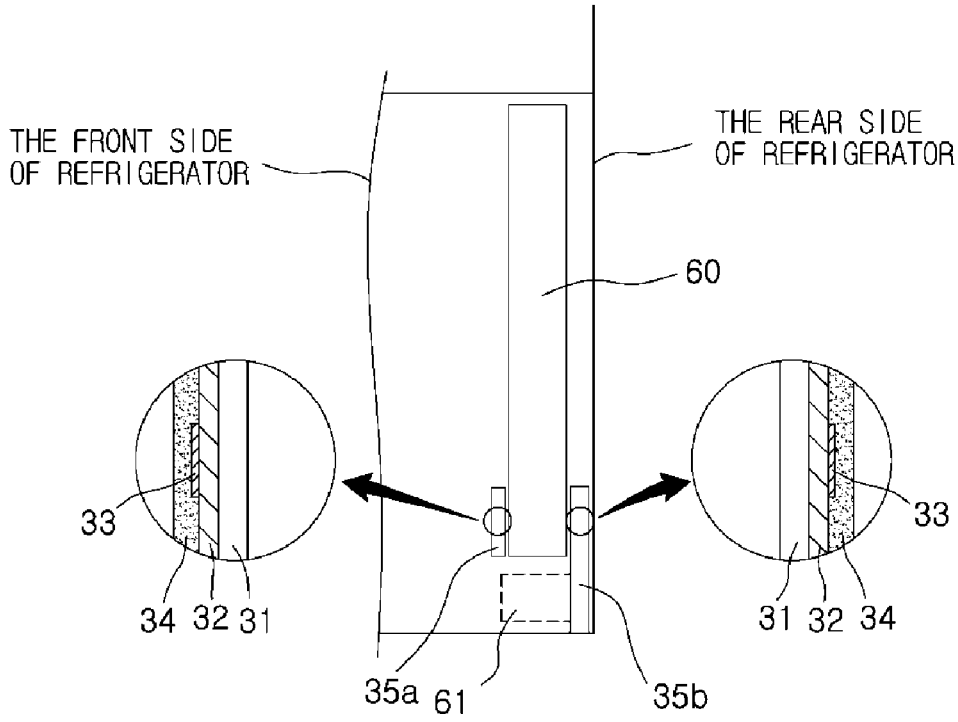
FIGS. 28 to 32 are side views schematically showing a configurational structure of installing front and rear defrost heaters on an evaporator, respectively.

FIG. 28 shows a side surface of an evaporator 60 that is installed toward the rear side of a refrigerator. A pair of front and rear defrost heaters 35*a* and 35*b* having a different length from each other are disposed on the front and rear surfaces of the evaporator 60. In this case, the front and rear defrost heaters 35*a* and 35*b* are arranged in a quarter (¼) region from the lower side of the evaporator 60, and are set to have a length that corresponds to the fact that the front and rear defrost heaters 35*a* and 35*b* have been arranged in the quarter (¼) region from the lower side of the evaporator 60.

The rear defrost heater 35*b* that is directed toward the refrigerator installation wall is extended to a lower defrost water exit tube 61, and the front defrost heater 35*a* that is directed toward the refrigerator door is located above to the upper portion of the lower defrost water exit tube 61. Approximately, the front defrost heater 35*a* is 100 mm long, and the rear defrost heater 35*b* is 200 mm long. The top portions of the front and rear defrost heaters 35*a* and 35*b* are equally set.

Referring to the partially enlarged cross-sectional view of FIG. 28, the front and rear defrost heaters 35*a* and 35*b* have the aluminum heat transfer boards 31 that are arranged on the contact surfaces with a number of radiation fins and are closely disposed to oppose each other.

If the front and rear defrost heaters 35*a* and 35*b* are arranged in the defrost apparatus, heat that is produced from the surface heat emission element 33 during performing a defrost action, is transferred to the aluminum heat transfer boards 31 whose heat transfer characteristic is excellent via the thin film first insulation layer 32, to then be transferred at uniform temperature to the upper and lower parts and the left and right parts of the aluminum heat transfer boards 31. Therefore, heat is transferred to a number of evaporator fins 23 of the evaporator 20 via the uniform temperature aluminum heat transfer boards 31, to thereby enable a uniform defrost operation.

Therefore, the defrost heaters 35*a* and 35*b* equally transfer heat generated from the surface heat emission element directly to the evaporator by a direct conduction method without causing any loss, to thereby enhance a defrost efficiency and decrease electric power consumption.

Temperature of the respective parts of the defrost apparatus according to the seventh embodiment of the present invention will be described below with respect to the following Table 2, in comparison with the conventional case.

The conventional art uses a glass heater that has a heater capacity of 562 W, and the seventh embodiment of the present invention uses a defrost heater shown in FIGS. 26 and 27 having a heater capacity of 180 W.

TABLE 2

| | Temp. of ice maker | Temp. of tube | Temp. of evaporator upper part | Temp. of evaporator middle part | Temp. of defrost water exit tube |
|---|---|---|---|---|---|
| Conventional art | 11.8 | −1.3 | 23.7 | 25.9 | 24.7 |
| 7th embodiment of the present invention | 7.5 | 3.5 | 12.6 | 13.8 | 17.5 |

As can be seen from the Table 2, the defrost heater is arranged on the lower end of the evaporator in the conventional art, and thus the defrost action is executed by a convection method. Accordingly, the temperatures of the middle and upper parts of the evaporator were high. As a result, the temperature of the ice maker was 11.8° C., to thereby cause a problem of melting existing produced ice.

Meanwhile, the defrost heater according to the seventh embodiment of this invention uses a low capacity heater that is one third (⅓) in comparison with the conventional art. Thus, even if low temperature heat emission is attained, heat is transferred to the evaporator by a conduction method of a direct contact. As a result, defrost of the evaporator is achieved within fast time, and the temperatures of the middle and upper parts of the evaporator were relatively lower by 10° C. or more than the conventional art. Therefore, the temperature of the ice maker was 7.5° C., to thereby solve a problem of melting existing produced ice.

That is, when the defrost heater according to the seventh embodiment of this invention is applied in the defrost apparatus, it can be confirmed that defrost and refrigerating cycles were repeated ten times for about four days. Time that is taken to operate the defrost heater during the defrost cycle is about 50 minutes, and time that is taken to make temperature of the evaporator after completion of defrost descend down to 0° C. reaches within five minutes even at the lower side of the evaporator, to thereby resume the refrigerating cycle quickly after completion of defrost.

Also, since temperature of the evaporator tube is −1.3° C. that is below zero in the conventional evaporator tube, frost that is formed on the surface of the evaporator tube does not melt but is attached on the surface of the evaporator tube together with water that flows down after having melted from the upper part of the evaporator tube, to thereby cause a problem of depositing layers of frost. However, temperature of the evaporator tube is 3.5° C. above zero in the present invention, to thereby solve the conventional problem.

Moreover, since the defrost heater 35*b* is arranged near the defrost water exit tube 61 in this invention, no problems happen in evaporating the defrost water collected in the defrost water exit tube 61 and melting a lump of frost and evaporate the thus-obtained defrost water.

As described above, the temperatures of the respective parts such as the evaporator and the tube showed a big difference therebetween in the conventional art. However, the front and rear defrost heaters 35*a* and 35*b* are arranged at the lower side of the refrigerator by a direct contact method, in this invention. Accordingly, since the lower side of the evaporator 60 and the defrost water exit tube 61 achieve defrost by a conduction method and the middle and upper parts of the evaporator achieve defrost by both a conduction method and a convection method, the temperature difference between the respective parts of the refrigerator is not large and optimum defrost temperature can be applied for each part of the refrigerator.

The modifications or variations of the present invention show that defrost of the evaporator can be effectively performed similarly to the above-described embodiments of the present invention, although the defrost heaters 35*a* and 35*b* are arranged at the front and rear sides of the evaporator 60, and positions, heights and sizes of the defrost heaters 35*a* and 35*b* are made to change.

Figure 29:
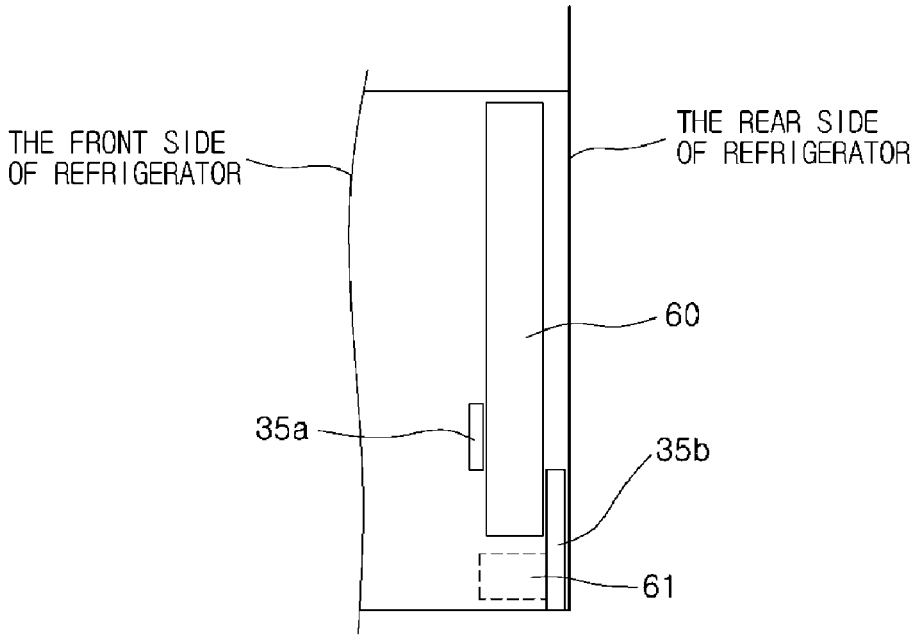

FIG. 29 shows a case that the front and rear defrost heaters 35*a* and 35*b* are arranged on the front and rear sides of the evaporator 60 to oppose each other, in which the heights of the front and rear defrost heaters 35*a* and 35*b* differ from each other. That is, FIG. 29 shows an example that position of the front defrost heater 35*a* has been moved to the upper portion of the evaporator 60. An identical defrost effect for the evaporator can be obtained even with the installation structure difference.

Figure 30:
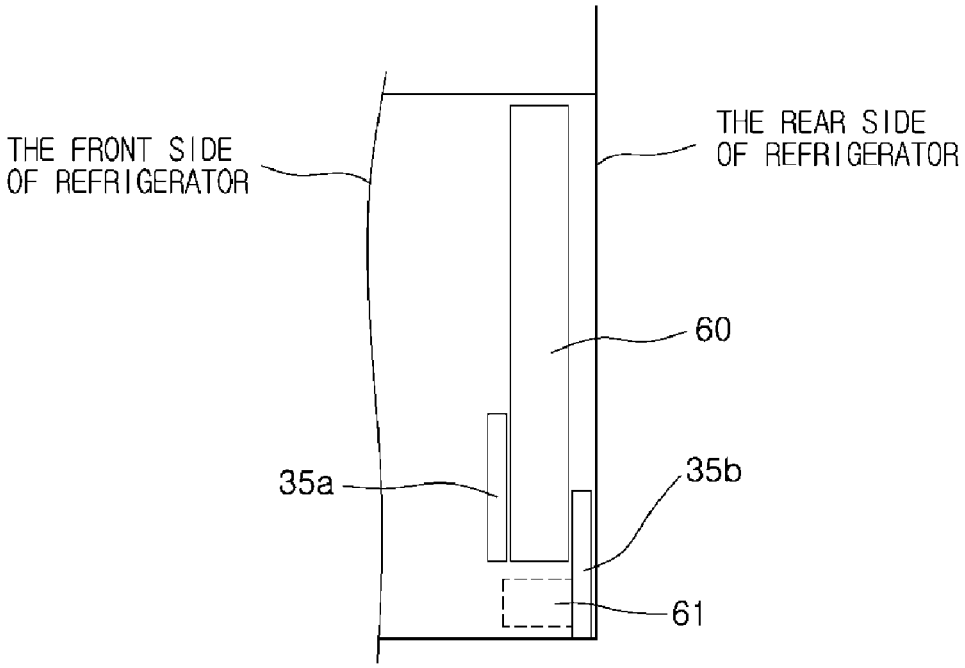

FIG. 30 shows a case that the front and rear defrost heaters 35*a* and 35*b* are arranged on the front and rear sides of the evaporator 60 to oppose each other, in which the front and rear defrost heaters 35*a* and 35*b* have an identical length each other. That is, the front defrost heater 35*a* that is directed toward the front side (or door side) of the refrigerator and the rear defrost heater 35*b* that is directed toward the rear side (or wall side) of the refrigerator are 200 mm long, respectively. FIG. 30 shows an example that position of the top portion of the refrigerator door side front defrost heater 35*a* is disposed higher than that of the rear defrost heater 35*b*.

Figure 31:
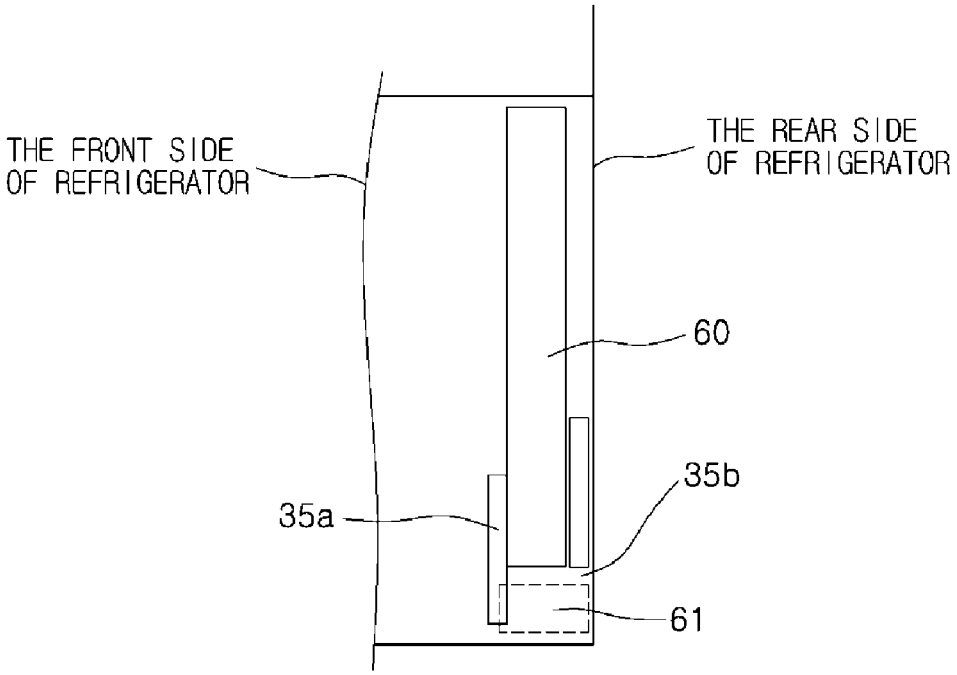

FIG. 31 shows a case that the front and rear defrost heaters 35*a* and 35*b* are arranged on the front and rear sides of the evaporator 60 to oppose each other, reversely to FIG. 30, in which the front and rear defrost heaters 35*a* and 35*b* have an identical length each other. FIG. 31 shows an example that the front defrost heater 35*a* is located down from the defrost water exit tube 61, and the rear defrost heater 35*b* is located above from the defrost water exit tube 61.

Figure 32:
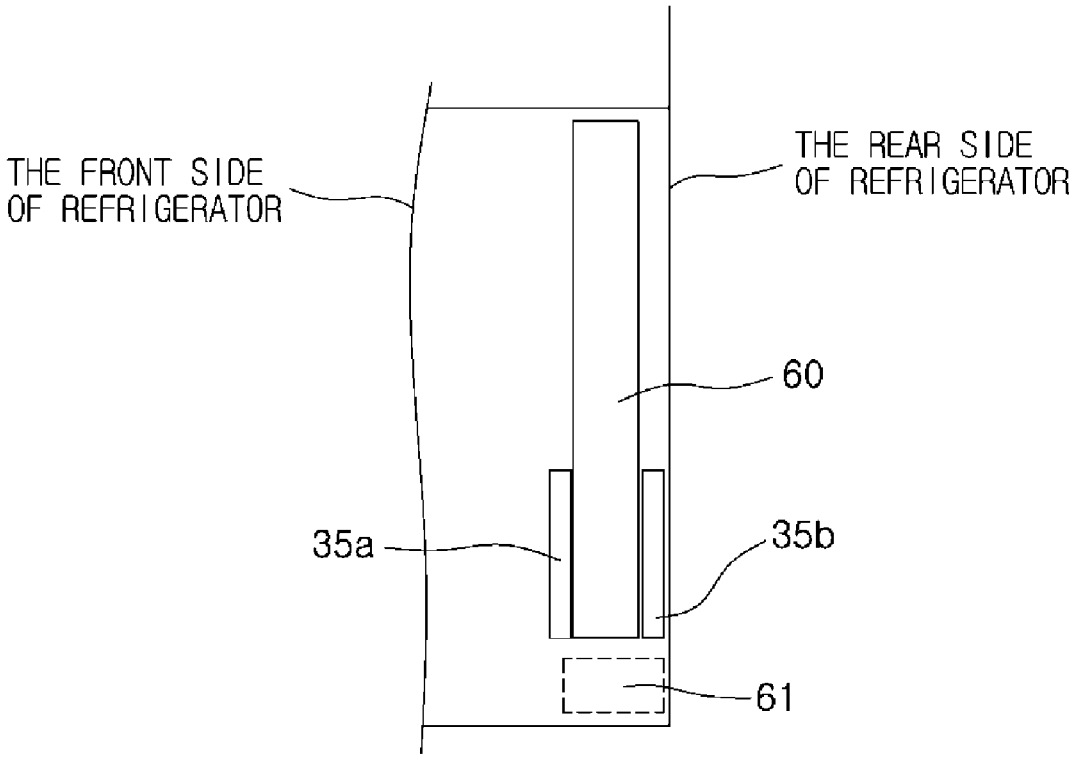

FIG. 32 shows a case that the front and rear defrost heaters 35*a* and 35*b* are arranged on the front and rear sides of the evaporator 60 to oppose each other, in which the front and rear defrost heaters 35*a* and 35*b* have an identical length each other, and are disposed at the same level above from the defrost water exit tube 61.

Figure 33:
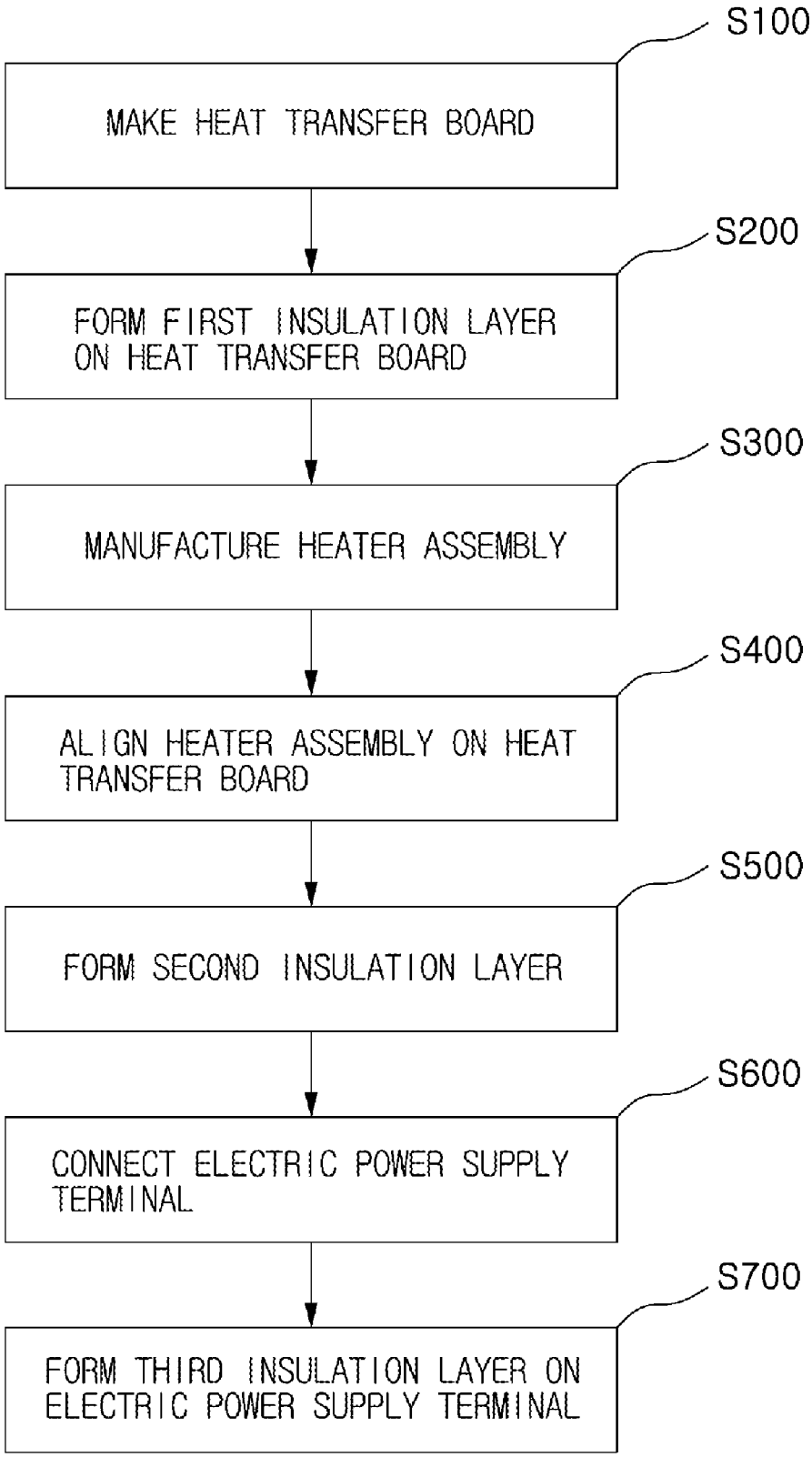
FIG. 33 is a flowchart view schematically showing a method of making a defrost heater according to an eighth embodiment of this invention.

FIG. 33 is a flowchart view schematically showing a method of making a defrost heater according to an eighth embodiment of this invention. FIGS. 34 to 37 are cross-sectional views showing a process of manufacturing the defrost heater according to the eighth embodiment of this invention.

Referring to FIGS. 33 to 37, a process of manufacturing a defrost heater according to an eighth embodiment of this invention will be first described below.

First, a heat transfer board 110 on which a heater assembly 120 (refer to FIG. 40) is fabricated into desired size of a rectangular shape, for example, is press-cut by a press cut processing method in the form of having a length corresponding to the left and right width of the evaporator and a width corresponding to part of the length of the evaporator. Thereafter, both sides of the heat transfer board 120 in the lengthy direction are bent by a bending unit, and then reinforced and strengthened so that the heat transfer board 120 is not bent or deformed after fabrication of the press-cut and bending processes (S100).

The heat transfer board 110 plays a role of supporting the heater assembly 120 stably and simultaneously transferring heat generated from the surface heater of the heater assembly 120 evenly to the evaporator. The heat transfer board 110 can be formed of one of Al, Cu, Ag and Au or an alloy material thereof, whose heat transfer characteristic is excellent. In this embodiment, aluminum that is considerably low price and is good for changing shape as well as light-weight has been used.

Figure 38:
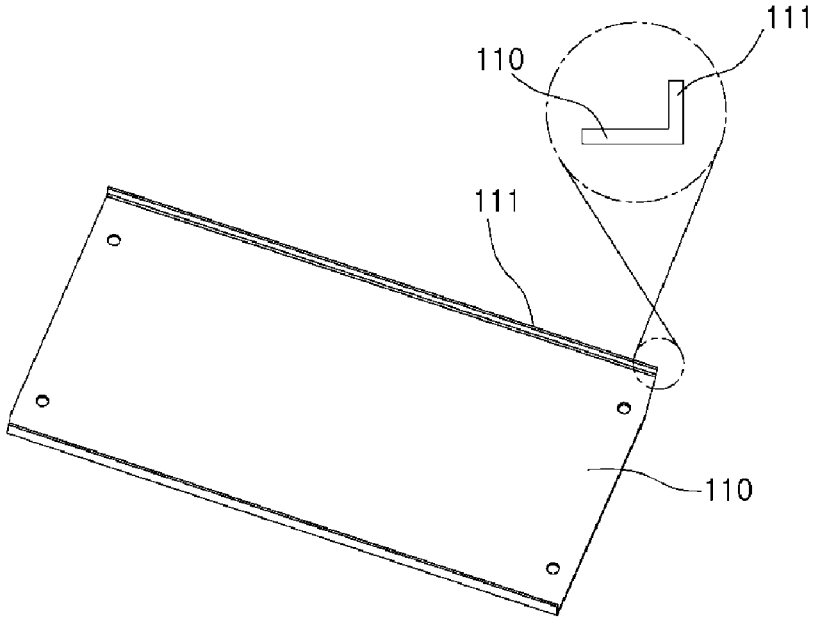
FIGS. 38 and 39 are illustrative diagrams showing a shape of a board, respectively.
Figure 39:
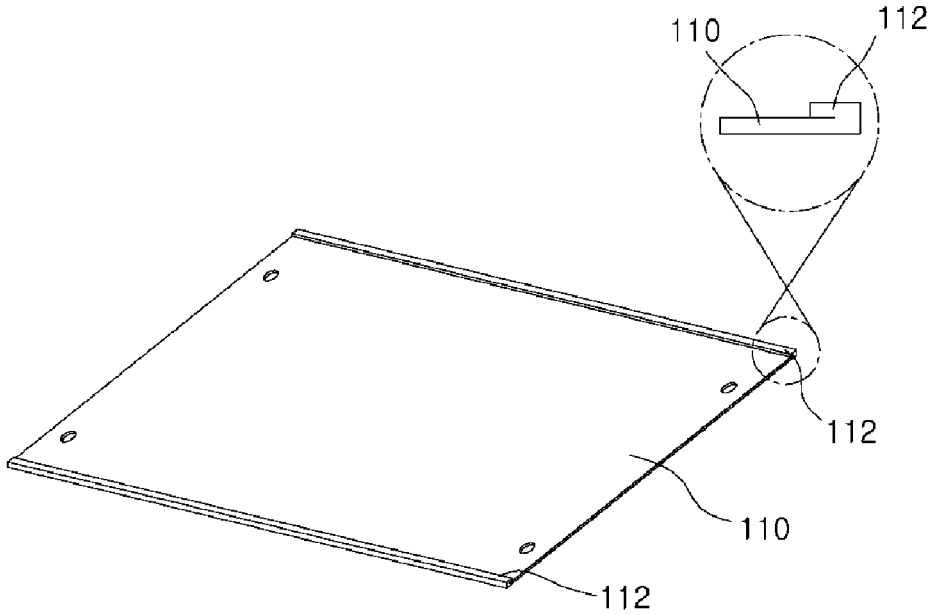

Referring to FIGS. 38 and 39, when the heat transfer board 110 made of Al is used, and is formed of a thickness of about 1 mm, the heat transfer board 120 is not bent or deformed after fabrication of the press-cut and bending processes even if both sides of the heat transfer board 120 in the lengthy direction are bent by a bending unit. However, in the case that thickness of the heat transfer board is set 0.5 mm or so for obtaining fast conduction efficiency and saving a material cost, it is desirable the left and right sides of the heat transfer board 110 are bent by a bending unit, and then reinforced and strengthened.

In the case that the Al plate of 1 mm thick is changed into that of 0.5 mm thick as the heat transfer board 110 as described above, and in the case that the defrost heater is applied for the evaporator, transition temperature of the evaporator has an advantage of increasing by 5-15° C. from 25-45° C. to 30-60° C., even if a capacity of the heater is lowered from 200 W to 180 W.

As a bending processing structure, reinforcement ribs 111 are formed by bending both sides of the heat transfer board 110, as shown in FIG. 38, or reinforcement ribs 112 are formed by bending both sides of the heat transfer board 110, and then folding the bent portions as shown in FIG. 39.

Figure 41:
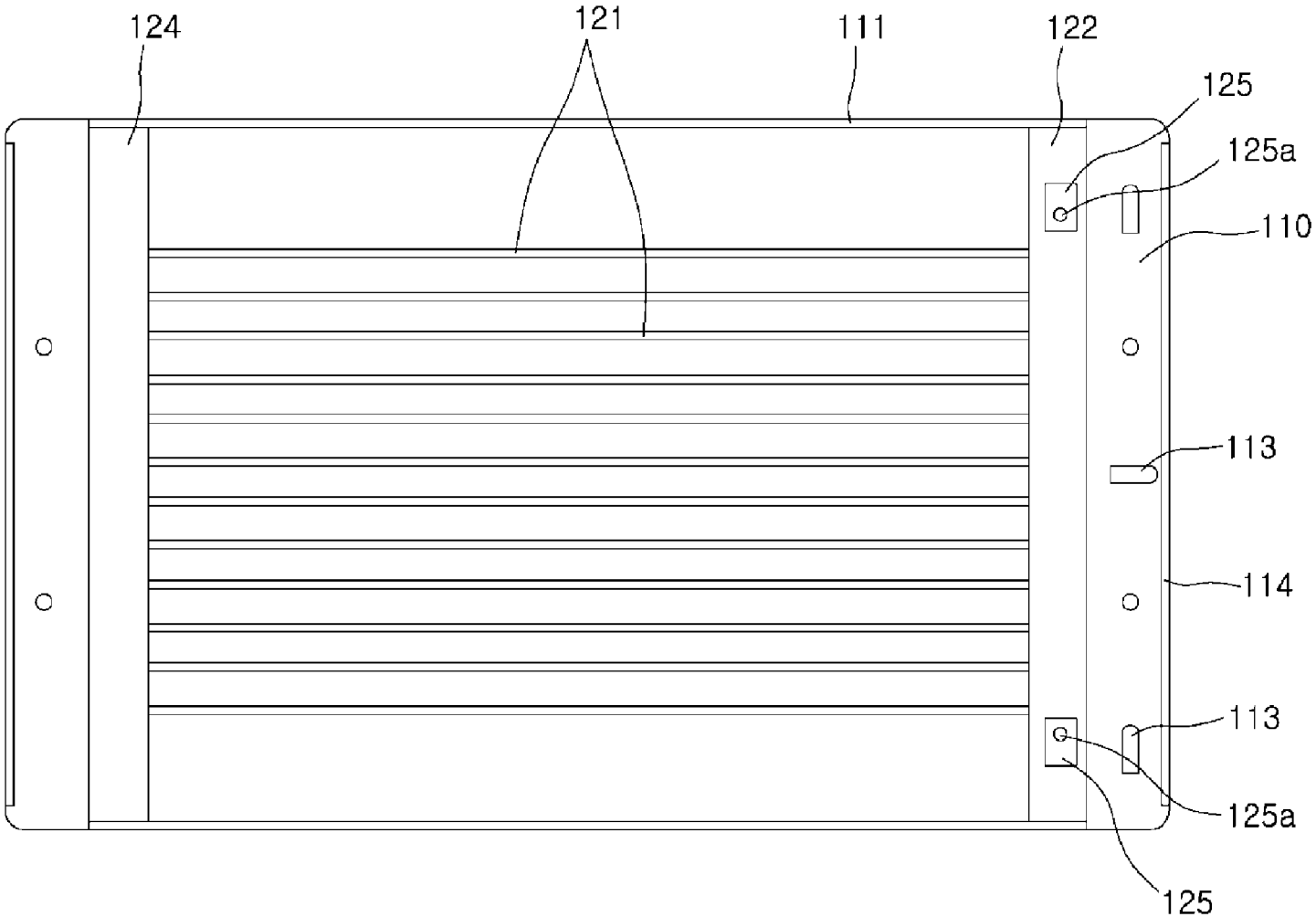
FIG. 41 is a plan view showing a state where a heater assembly is arranged on a board.
Figure 42:
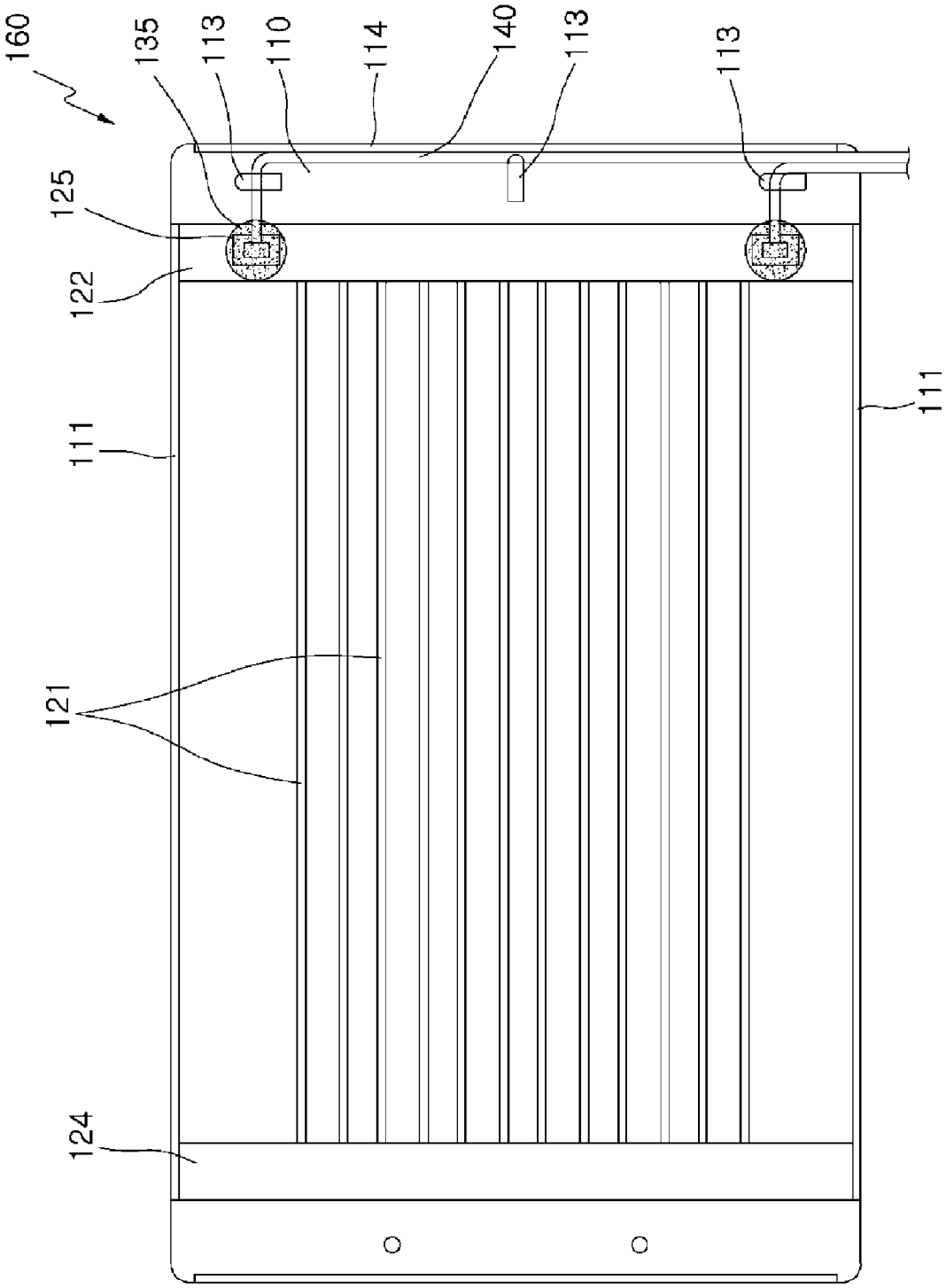
FIG. 42 is a plan view showing the defrost heater according to the eighth embodiment of this invention.

Also, as illustrated in FIGS. 41 and 42, reinforcement ribs 114 that are bent at right angle are desirably formed on both ends of the heat transfer board 110 in the lengthy direction. A number of fixing pieces 113 that are connected to the heat transfer board 110 are formed adjacent to the reinforcement ribs 114 simultaneously at the time of the press process, in order to fix electric power cables 140 that are withdrawn from the heater assembly 120 that is mounted on the heat transfer board 110. The leading ends of the number of the fixing pieces 113 are widened and then the electric power cables 140 are inserted into the widened groove and then the leading ends of the fixing pieces 113 are bent to simply fix the electric power cables 140.

Figure 34:
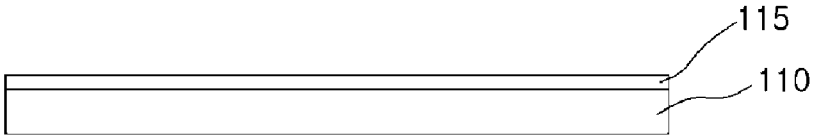
FIGS. 34 to 37 are cross-sectional views showing a process of manufacturing the defrost heater according to the eighth embodiment of this invention.

Then, an electric insulation processing is executed on the heat transfer board 110 and a first insulation layer 115 is formed with a thickness of 30-100 μm on one surface of the heat transfer board 110, as shown in FIG. 34 (S200). In the case that the heat transfer board 110 is made of aluminum, surface of the aluminum heat transfer board 110 is anodized to thus form an alumina insulation film of 30-40 μm thick. Otherwise, silicon varnish coating of 50-70 μm thick or plasma coating of 30-50 μm thick can be executed on the aluminum heat transfer board 110.

Since the alumina insulation film that has been formed by anodizing the surface of the aluminum heat transfer board 110 has a low surface illumination, both anodizing and silicon varnish coating can be executed simultaneously in order to heighten the surface illumination. As the first insulation layer 115 of the heat transfer board 110, plasma coating is excellent for both the insulation and conductivity.

Moreover, in the case that minute grooves on the surface of the heat transfer board 110 is sealed with nano-particle germanium in order to heighten surface illumination, insulation-resistance voltage of 3000V or higher that can guarantee an insulation performance even if the heater directly contacts surface of the heat transfer board 110.

It is desirable that thickness of the first insulation layer 115 is set according to a voltage environment where a surface heater is used. Here, if thickness of the first insulation layer 115 is too thin as 30 μm or lower, a problem happens in view of the insulation performance. On the contrary, if thickness of the first insulation layer 115 is too thick as 100 μm or higher, thermal conductivity is decreased.

Also, it is possible to use thermosetting resin coating or Teflon coating other than the insulation method.

Hereinbelow, a method of assembling the heater assembly according to this invention will be described with reference to FIG. 40 (S300).

Figure 35:
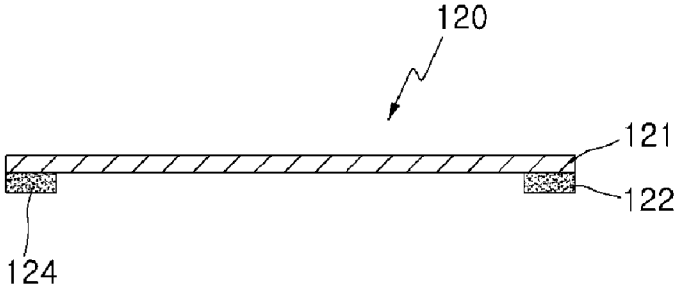
Figure 36:
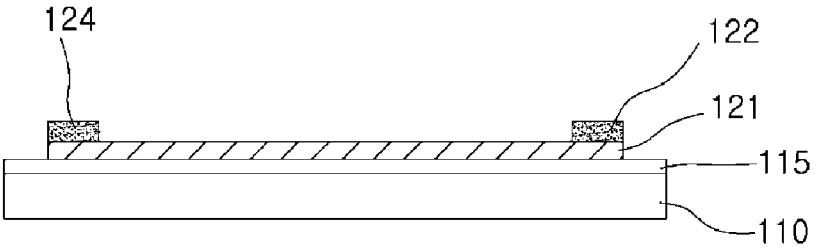
Figure 37:
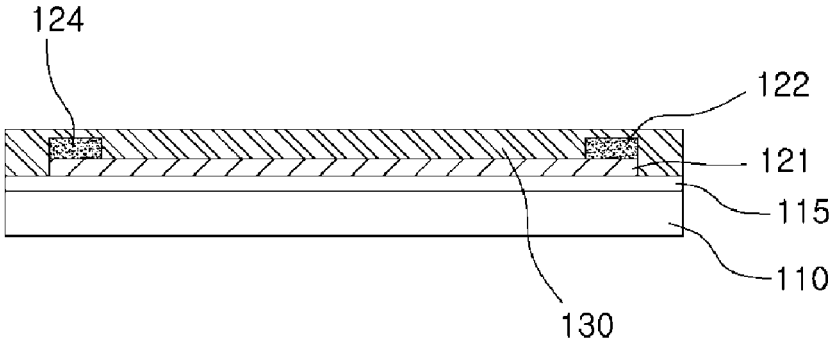
Figure 40:
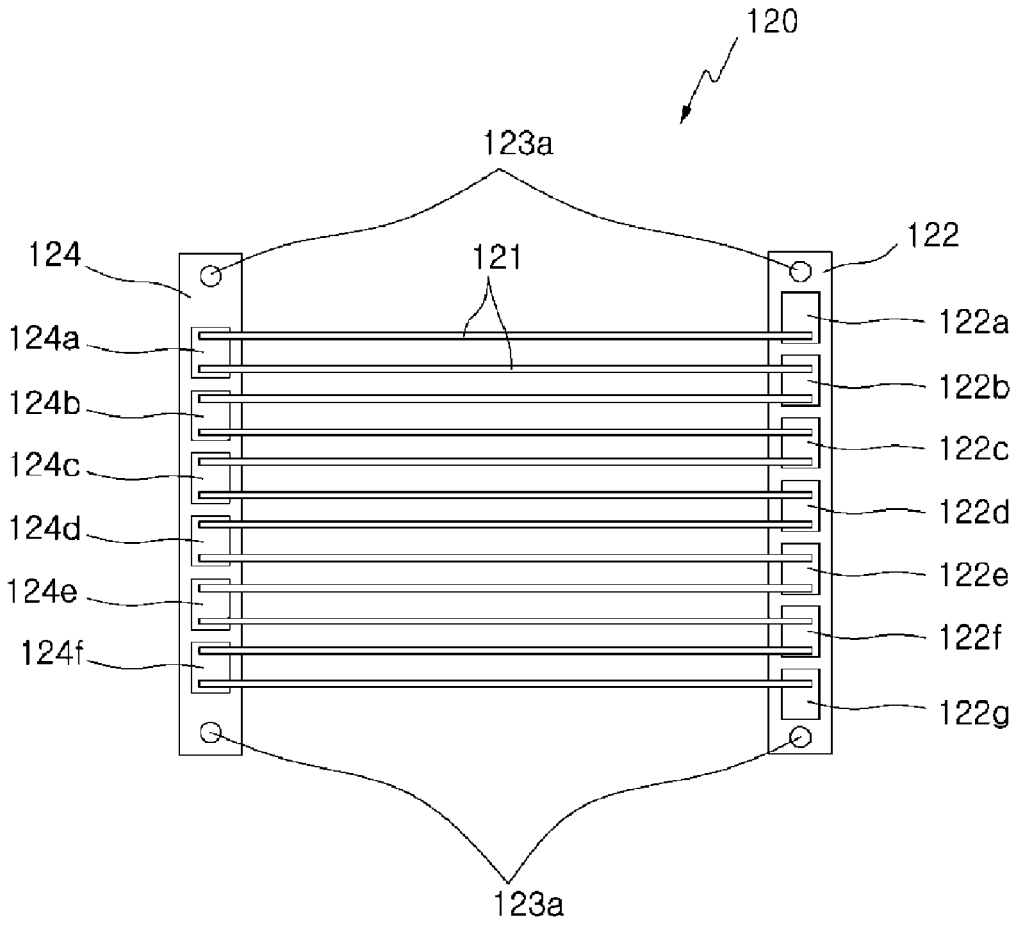
FIG. 40 is a plan view showing a heater assembly according to an embodiment of this invention.

As shown in FIGS. 35 and 40, the heater assembly 120 according to this invention is formed of a number of linear surface heat emission elements 121 that are obtained by cutting a metal thin film and first and second heater assembly printed-circuit boards (PCBs) 122 and 124 that connect the number of the linear surface heat emission elements 121 in series.

In this case, the first and second heater assembly printed-circuit boards (PCB) 122 and 124 are formed by using a FR4-series epoxy board, a metal PCB or a ceramic PCB, as the insulation board.

A number of connection pads 122*a*-122*g*; 124*a*-124*f* for successively connecting a number of the surface heat emission elements 121 are formed on the first and second heater assembly PCBs 122 and 124 with a predetermined pitch at predetermined interval, and are made of a conductive material, or example, Cu. It is preferable that tin (Sn) or gold (Au) is plated on the surfaces of the connection pads 122*a*-122*g*; 124*a*-124*f*.

It is desirable that a double-sided PCB as the first heater assembly PCB 122, in order to form electric power terminal pads 125 to which electric power terminals of the electric power cables 140 on the rear surface of the PCB as shown in FIGS. 41 and 42. The connection pads 122*a* and 122*g* that are arranged on both ends of the first heater assembly PCB 122, among the connection pads 122*a*-122*g* of the first heater assembly PCB 122, are electrically connected with the electric power terminal pads 125 that are formed on the rear surface of the first heater assembly PCB 122, via conductive throughholes 125*a*.

A number of the connection pads 122*a*-122*g* of the first heater assembly PCB 122 are formed in larger number by one than that of a number of the connection pads 124*a*-124*f* of the second heater assembly PCB 124.

The connection pads 122*a*-122*g* of the first heater assembly PCB 122 are deflected and positioned with respect to the connection pads 124*a*-124*f* of the second heater assembly PCB 124, so as to be appropriate for connecting a number of surface heat emission elements 121 in series. It is also preferable that a pair of rivet holes 123*a* and 123*b* is formed at both ends of the first and second heater assembly PCB 122 and 124 so as to fix the heater assembly 120 on the heat transfer board.

In the case of the heater assembly 120, the first and second heater assembly PCBs 122 and 124 are arranged at both sides of the heater assembly 120, at a distance from each other, both ends of a number of the surface heat emission elements 121 are connected to a number of the connection pads 122*a*-122*g* of the first heater assembly PCB 122 and a number of the connection pads 124*a*-124*f* of the second heater assembly PCB 124, respectively, to thus connect a number of the surface heat emission elements 121 in series, and the electric power terminals of the electric power cables 140 are connected to the electric power terminal pads 125 that are formed on the rear surface of the heater assembly 120.

A bonding method using a conductive adhesive, a spot welding method, or a laser welding method is used as a method that connects a number of the surface heat emission elements 121 on a number of the connection pads 122*a*-122*g*; 124*a*-124*f*. The methods of connecting a number of the surface heat emission elements 121 on a number of the connection pads 122*a*-122*g*; 124*a*-124*f*, do not exceed 170° C. at the time of heat emission of the surface heat emission elements 121, to thereby cause no problems between the surface heat emission elements 121 and the connection pads 122*a*-122*g*; 124*a*-124*f*.

The heater assembly 120 is formed by connecting a number of the surface heat emission elements 121 with a number of the connection pads 122*a*-122*g*; 124*a*-124*f* by a series connection method. If electric power is applied through the electric power terminals of the electric power cables 140 and a number of the surface heat emission elements 121, a number of the surface heat emission elements 121 are connected in series through the connection pads 122*a*-122*g*; 124*a*-124*f*, to thereby enable a desired capacity of heat emission.

However, a number of the surface heat emission element 121*s* can be connected in a series and/or parallel connection methods, according to a rating capacity required by the heater assembly 120.

As will be described later, a number of the surface heat emission elements 121 that are used in the heater assembly 120 according to this invention use a number of strips that are obtained by slitting a metal thin film of predetermined thickness in a linear pattern.

It is desirable that a specific resistance value required as a characteristic of a heat wire material is large (usually extent of 1.0-1.4 $\Omega mm^2/m$) in the case of the surface heat emission elements 121 of the strip form. However, if an inexpensive heat wire material is available in the case that the specific resistance value is at least one, any metal materials or alloy materials can be used.

However, if the specific resistance value is smaller than one, and in the case that a number of the surface heat emission elements 121 are connected in series, size of the heater assembly 120 is gradually increased when a more number of surface heat emission elements should be used to increase a heater capacity, considering that a heater having a capacity of about 200 W is generally used as a defrost apparatus for use in an evaporator of a refrigerator. Thus, it is undesirable to use the heat wire whose specific resistance value is smaller than one.

The surface heat emission elements 121 of such a strip form is made of the same material as that of the defrost heater of the first embodiment of the present invention.

As a result, the surface heat emission element 121*s* of strip form that is manufactured by processing a ribbon that is made of an amorphous thin plate in this invention do not need to form a thick heat-proof or insulation coating layer on the outer circumference of the heat emission elements, considering relatively excessive and/or high temperature thermogenesis, when compared with a conventional coil style heat wire made of a nichrome wire. Therefore, heat that is generated from the heat emission elements can be transferred at a high heat conduction/transfer state with high heat transfer efficiency.

In addition, the surface heat emission element 121 of strip form according to this invention does not require for a precise temperature control that uses an expensive controller, because the surface temperature of the heater does not rise up to high temperature of 600-800° C. like the sheath heater and does not exceed 170° C. That is, in this invention, the defrost action can be achieved by only a simple ON/OFF control of the electric power that is applied to the surface heat emission elements 121, in this invention.

Moreover, when the surface heat emission elements 121 according to this invention is made using an amorphous material, heat emission is basically attained lower by 100° C. or below than a boiling point of an environment-friendly refrigerant, to thus meet the UL recommendations.

However, if short-circuit happens partially in the heat emission element and thus temperature of the heater rises up above an ignition point of the environment-friendly refrigerant, the surface heat emission element material of amorphous alloy is crystallized to thereby be electrically cut off momentarily as if a fuse were cut off.

That is, since atoms are randomly oriented anarchically in an amorphous tissue in view of crystallography in metals, specific resistance appears very greatly, but crystallization proceeds. Accordingly, since the atoms are arranged with a predetermined structure in the case of having a crystalline texture, the specific resistance is low. Also, in the case that the amorphous tissue is used as a thin film surface or linear heat emission element, electrical cutoff happens by heat emission that is produced by a high electric current flow.

As a result, the surface heat emission element made of an amorphous material according to this invention does not cause a fire by overheat, but loses a heater function, to thereby provide a new heater material that secures self-safety.

Meanwhile, the surface heat emission element 121 that is employed in this invention should be set to have a resistance value that is suitable for implementing a heater capacity of about 200 W so that heat emission may be attained within a range of a predetermined temperature and time that is needed for defrosting an evaporator for use in a refrigerator.

For this purpose, a material of the surface heat emission element 121 is a metal thin plate. Accordingly, for example, if predetermined width, length and area of a surface type defrost heater are decided according to size of an evaporator, an amorphous ribbon of broad width is slitted in a strip form having predetermined width.

Thereafter, predetermined overall length of the surface heat emission element that has been slitted by the predetermined width is cut into a number of surface heat emission elements 121 having equal length according to width of the evaporator, and the number of the surface heat emission elements 121 are connected by a series connection method using the first and second heater assembly PCBs 122 and 124, as illustrated in FIG. 40, to thereby complete a heater assembly 120 and obtain a defrost heater that has a desired heater capacity.

When the surface heat emission elements are made of an amorphous material, a method of forming or molding the surface heat emission elements into a zigzag pattern of a series connection method by a press finishing or etching method, may cause a big loss of a material, a difficult processing, and an expensive processing expense, but the method of forming the surface heat emission elements by a slitting method makes a forming or molding process easy and causes little material loss. In addition, a number of the surface heat emission elements 121 can be easily assembled and achieved in a slim form by using the first and second heater assembly PCBs 122 and 124.

However, in the case that the surface heat emission element is made of a material except the amorphous material, for example, FeCrAl, it is possible to form or mold the surface heat emission element by a press finishing or etching method in a zigzag pattern by the series connection method, but there is a problem that the etching method may cause an expensive processing expense.

Nevertheless, in the case that a heater capacity is small, and a zigzag pattern area is small, the surface heat emission element can be formed or molded by the etching method. Also, in the case that uniformity of temperature preservation is required and an area that is allowable for the heater is large, because of a large heating area, a number of surface heat emission elements can be connected by a parallel connection method as well as a series connection method.

Referring back to FIG. 33, the heater assembly 120 is fixed on the heat transfer board 110 after the heater assembly 120 has been completely assembled (S400).

Here, in the case of the heater assembly 120, the surface heat emission elements 121 are arranged to contact the first insulation layer 115 on the heat transfer board 110 where the first insulation layer 115 has been formed as shown in FIG. 41, and thus the heater assembly PCBs 122 and 124 are arranged on the upper portions of the surface heat emission elements 121. Then, the heater assembly 120 is fixed on the heat transfer board 110, using a pair of rivet holes 123*a* and 123*b* that are positioned at both ends of the first and second heater assembly PCB 122 and 124.

In this case, silicon varnish is preferably coated on the upper portion of the first insulation layer in a thin film form on the heat transfer board 110, and it is good to attach the heater assembly 120 on the heat transfer board 110, using the coated silicon varnish thin film as an adhesive.

Then, after the heater assembly 120 has been arranged on the heat transfer board 110, silicon varnish is coated on the remaining portions except for the electric power terminal pads 125 of the heater assembly 120, to thereby form a second insulation layer 130 (S500). The second insulation layer 130 can be formed in the same manner as that of the above-described first insulation layer 115. In this embodiment, the whole heater assembly 120 is sealed with a thickness of 0.5-1.0 mm using silicon varnish, to thereby attain insulation.

Thus, if the second insulation 130 has been completed, the electric power terminals of the electric power cables 140 are spot welded to a pair of the electric power terminal pads 125 that are exposed on the heater assembly PCB 122 as shown in FIG. 42 (S600).

The terminal pads 125 are linked with the connection pads 122*a* (refer to FIG. 40) of the heater assembly PCB 122 through the conductive throughholes 125*a*. Thus, if electric power is applied through the electric power cables 140, electric power is applied to a number of the surface heat emission elements 121 connected on the connection pads 122*a* via the throughholes 125*a* and thus all of a number of the surface heat emission elements 121 emit heat.

Finally, silicon varnish is coated on the upper portions of the electric power terminal pads 125 to which the electric power terminals are connected, to thereby form a third insulation layer 135 (S700).

If the third insulation layer 135 for sealing is formed on the upper portions of the electric power terminal pads 125*a* as described above, sealing of the whole heater assembly 120 is completed.

Thereafter, the electric power cables 140 that are withdrawn from the electric power terminal pads 125 are induced to the wall of the reinforcement rib 114, and then arranged. Then, the electric power cables 140 are depressed and fixed using a number of fixing pieces 113. Accordingly, the electric power cables 140 are simply fixed. Such a cable fixing method can help enhancement of a tensile force.

Figure 43:
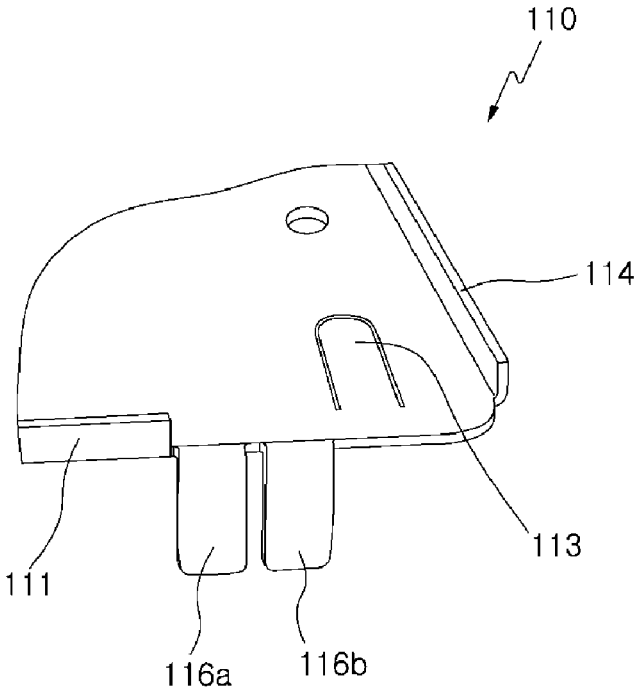
FIG. 43 is a perspective view showing a structure of fixing a defrost heater.
Figure 44:
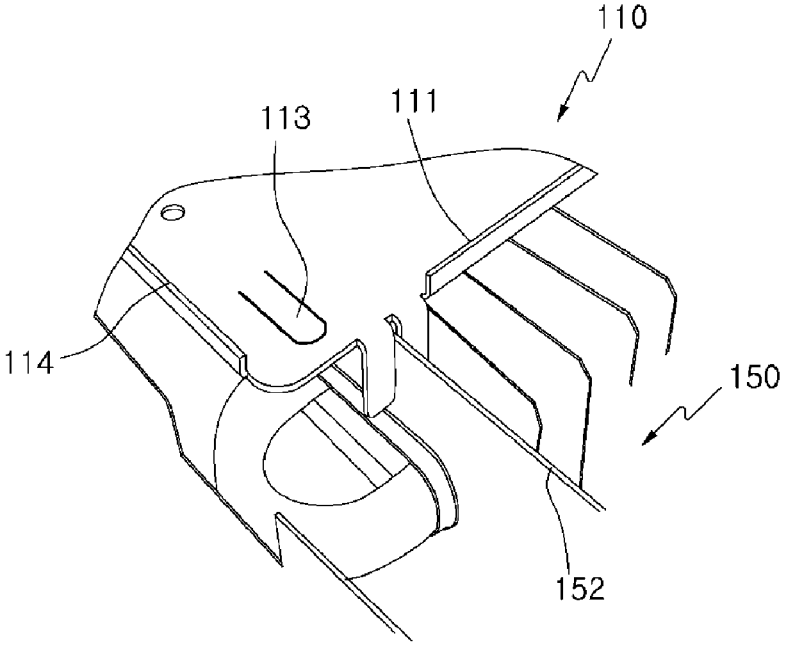
FIG. 44 is a perspective view showing a state where a defrost heater is mounted on an evaporator.

Meanwhile, when the metal thin plate is cut by a press processing method in this invention, four pairs of coupling pieces 116*a* and 116*b* that can be used to fixedly couple a defrost heater 160 that is completed later on a support frame 152 of an evaporator 150 as shown in FIGS. 43 and 44, are integrally formed at four corners of the heat transfer board 110 with a predetermined interval.

In the case that the four pairs of coupling pieces 116*a* and 116*b* are integrally formed at four corners of the heat transfer board 110, the defrost heater 160 can be easily fixed on the support frame 152 of the evaporator 150, without using a separate fixing unit.

In this case, the defrost apparatus is desirably formed of a front defrost heater and a rear defrost heater. The front defrost heater is made of length corresponding to width of the evaporator 150 and width of 70-110 mm and is attached on the lower end of the evaporator 150, and the rear defrost heater is made of length that corresponds to width of the evaporator 150 and width of 150-210 mm and is arranged to cover a defrost water freeing tube (not shown) that is positioned at the lower end of the evaporator 150.

As described above, the present invention uses a surface heat emission element that is obtained by fabricating a metal thin plate into a strip form as a heater, in which a number of linear surface heat emission elements are connected in series to and/or in parallel with each other to have a proper capacity as a heater for use in a defrost apparatus, using a pair of heater assembly PCBs (printed circuit boards), to thereby minimize a material loss, and heighten assembly productivity, durability and reliability, and assemble a heater assembly into a slim type.

The present invention employs a metal thin film surface heat emission element in which heat emission is basically attained at a temperature not more than an ignition point of a refrigerant because of low thermal density, and thus temperature control of the heater is possible by a simple ON/OFF control without using any expensive controller and has a very fast temperature response performance, and is strong even for thermal shock, to thereby perform quick cooling after completion of defrost, to thereby quickly restart a refrigeration cycle and to thus heighten a heat transfer efficiency to maintain maximization of an electric power to heat conversion efficiency.

Further, the present invention uses an amorphous material as a material of a surface heat emission element, in which the amorphous material is crystallized in the case that temperature of the heater is risen above an ignition point of an environment-friendly refrigerant, to thereby cause natural electric cutoff and to thus secure safety due to overheat.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

As described above, a surface defrost heater according to the present invention may be applied to a defrost heater for an evaporator, which employs a metal thin film surface heat emission element whose temperature response performance is fast and thermal density is low, to thereby make surface temperature of the heater sufficiently lower than an ignition point of an environment-friendly refrigerant and to thus use the environment-friendly refrigerant, and to quickly perform temperature rising and cooling during performing a defrost cycle and to thus greatly shorten time required for performing the defrost cycle.

The invention claimed is:

1. A defrost heater that removes frost that is produced on an evaporator of a refrigerating apparatus through which a refrigerant flows, the defrost heater comprising:

a heater assembly that comprises: first and second heater assembly PCBs that comprise a number of first and second conductive connection pads that are arranged at predetermined intervals, respectively, and a number of strip type surface heat emission elements that are made of a strip type metal thin plate and both ends of which are connected between the number of the first conductive connection pads of the first heater assembly and the number of the second conductive connection pads of the second heater assembly;

a heat transfer board that is closely fixed to one side surface of the evaporator and receives heat generated from the number of the strip type surface heat emission elements that have been mounted on an outer surface of the evaporator and transfers the received heat to the evaporator; and an insulation layer that seals an exposed portion of the heater assembly.

2. The defrost heater according to claim 1, wherein the number of the strip type surface heat emission elements are connected by a series connection method between the number of the first conductive connection pads and the number of the second conductive connection pads.

3. The defrost heater according to claim 1, wherein the number of the strip type surface heat emission elements are connected on the connection pads through bonding that uses a conductive adhesive, spot or laser welding.

4. The defrost heater according to claim 1, wherein both sides lengthily opposing each other in the board comprise reinforcement ribs, respectively, in order to prevent the board from being deformed when thickness of the board is shortened.

5. The defrost heater according to claim 1, wherein the first heater assembly PCB is formed of a double-sided PCB and a pair of connection pads that are arranged at both ends of the number of the first conductive connection pads are connected with a pair of electric power supply terminal pads that are formed on the rear surface of the first heater assembly PCB through a throughhole, respectively.

6. The defrost heater according to claim 1, further comprising: reinforcement ribs that are bent perpendicular with a number of fixed pieces for fixing electric power cables connected to the electric power supply terminal pads on the board, on one side of the board adjoining the first heater assembly PCB.

7. The defrost heater according to claim 1, wherein the number of the strip type surface heat emission elements are electrically cut off in the case that heat emission is attained higher than an ignition point of the refrigerant.

8. A method of manufacturing a defrost heater, the defrost heater manufacturing method comprising the steps of:

preparing a number of strip type surface heat emission elements by slitting a metal thin plate and then cutting the slit metal thin plate;

preparing a first heater assembly PCB in which a number of first conductive connection pads are formed at given intervals and a second heater assembly PCB in which a number of second conductive connection pads are formed at given intervals;

forming a heater assembly by connecting in series both ends of the number of the strip type surface heat emission elements between the number of the first conductive connection pads of the first heater assembly and the number of the second conductive connection pads of the second heater assembly;

attaching the heater assembly on one surface of an heat transfer board and sealing an exposed portion of the heater assembly; and connecting a pair of electric power cables from a pair of connection pads that are arranged at both ends of the number of the first conductive connection pads to a pair of electric power supply terminal pads that are formed on a rear surface of the first heater assembly PCB through a throughhole, respectively.

9. The defrost heater manufacturing method of claim 8, further comprising the step of forming any one insulation film among an alumina insulation film, a silicon varnish coating film, a plasma coating film, and a double film of an alumina insulation film and a silicon varnish coating film on one side surface of the heat transfer board.

10. The defrost heater manufacturing method of claim 8, wherein the number of the strip type surface heat emission elements are made of an amorphous material that is electrically cut off in the case that heat emission is performed higher than an ignition point of a refrigerant.

* * * * *